US009384720B2

(12) United States Patent
Oba et al.

(10) Patent No.: US 9,384,720 B2
(45) Date of Patent: Jul. 5, 2016

(54) KEYBOARD MUSICAL INSTRUMENT, AND METHOD FOR RECORDING HALF PERFORMANCE OF PEDAL OR KEY DAMPER ON KEYBOARD MUSICAL INSTRUMENT

(71) Applicant: YAMAHA CORPORATION, Hamamatsu-shi, Shizuoka-Ken (JP)

(72) Inventors: Yasuhiko Oba, Hamamatsu (JP); Yuji Fujiwara, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/250,762

(22) Filed: Apr. 11, 2014

(65) Prior Publication Data

US 2014/0305285 A1 Oct. 16, 2014

(30) Foreign Application Priority Data

Apr. 11, 2013 (JP) ..... 2013-082851

(51) Int. Cl.
*G10H 1/34* (2006.01)
*G10F 1/02* (2006.01)
*G10C 3/26* (2006.01)

(52) U.S. Cl.
CPC ..... *G10H 1/344* (2013.01); *G10C 3/26* (2013.01); *G10F 1/02* (2013.01); *G10H 1/348* (2013.01); *G10H 2220/265* (2013.01); *G10H 2220/305* (2013.01)

(58) Field of Classification Search
USPC ..... 84/615, 653
IPC ..... G10H 1/344,1/348, 2220/265, 2220/305
See application file for complete search history.

(56) References Cited

U.S. PATENT DOCUMENTS 5,523,522 A 6/1996 Koseki et al.
5,545,839 A 8/1996 Kawamura et al.

(Continued)

FOREIGN PATENT DOCUMENTS

JP 2007292921 A 11/2007
JP 4305319 B2 5/2009
JP 4524798 B2 6/2010

OTHER PUBLICATIONS

Office Action issued in U.S. Appl. No. 14/250,930 mailed Jul. 9, 2014.

(Continued)

*Primary Examiner* — David Warren
(74) *Attorney, Agent, or Firm* — Rossi, Kimms & McDowell LLP

(57) ABSTRACT

Dampers provided in corresponding relation to a plurality of keys are each controlled in response to both an operation of a pedal and an operation of the corresponding key. One half region or half point is determined based on a plurality of half pedal regions or half pedal points, in a stroke of the pedal, specific to the individual dampers. Performance data instructing a pedal operation is generated and recorded on the basis of a stroke position detected in response to a pedal operation and the determined one half region or half point. For each of the keys, a key-damper half region or key-damper half point in a stroke of the key is identified in advance. Performance data instructing key operations is generated and recorded on the basis of the key-damper half regions or key-damper half points specific to the keys and stroke positions detected in response to key operations.

14 Claims, 11 Drawing Sheets

(56) References Cited

U.S. PATENT DOCUMENTS

| | | | | |
|---|---|---|---|---|
| 5,714,702 | A | 2/1998 | Ishii | |
| 5,905,220 | A | 5/1999 | Lee et al. | |
| 5,936,172 | A | 8/1999 | de La Rochefordiere | |
| 7,332,670 | B2 | 2/2008 | Fujiwara et al. | |
| 7,381,880 | B2 | 6/2008 | Fujiwara et al. | |
| 7,521,626 | B2 | 4/2009 | Muramatsu | |
| 7,943,843 | B2 | 5/2011 | Komatsu | |
| 2001/0027714 | A1* | 10/2001 | Kondo et al. | 84/615 |
| 2001/0035089 | A1 | 11/2001 | Furuki | |
| 2006/0021488 | A1* | 2/2006 | Fujiwara | G10F 1/02 84/13 |
| 2007/0214944 | A1* | 9/2007 | Sasaki et al. | 84/615 |
| 2007/0256550 | A1 | 11/2007 | Muramatsu | |
| 2009/0314156 | A1* | 12/2009 | Komatsu | 84/626 |
| 2010/0089225 | A1* | 4/2010 | Maruyama | 84/626 |
| 2010/0288102 | A1* | 11/2010 | Fujiwara et al. | 84/13 |
| 2012/0255425 | A1* | 10/2012 | Oba et al. | 84/746 |
| 2013/0180377 | A1 | 7/2013 | Oba et al. | |
| 2013/0180391 | A1* | 7/2013 | Oba et al. | 84/746 |
| 2014/0182444 | A1* | 7/2014 | Fujiwara et al. | 84/229 |

OTHER PUBLICATIONS

Notice of Allowance issued in U.S. Appl. No. 14/250,930 mailed Oct. 28, 2014.

Office Action issued in U.S. Appl. No. 14/250,810, mailed Aug. 14, 2015.

Office Action issued in U.S. Appl. No. 14/250,962, mailed Jul. 30, 2015.

* cited by examiner

```
F0 43 71 7E
        dd              DATA TYPE = "LIFTING RAIL NOTE-OFF"
        15 aa bb cc     MIDI note, FLOOR POINT, CEILING POINT,
        16 aa bb cc     HALF POINT
        17 aa bb cc
           :
        59 aa bb cc
F7
```

FIG. 5A

```
xH = a*(k-kL)^2 + xH0
                        DATA TYPE = "DAMPER-PEDAL FLOOR POINT"
F0 43 71 7E                         "DAMPER-PEDAL CEILING POINT"
        dd                          "DAMPER-PEDAL HALF POINT"

        ee aa bb        COEFFICIENT a, VALUE (L), VALUE (H)
        ff aa bb        COEFFICIENT kL, VALUE (L), VALUE (H)
        gg aa bb        COEFFICIENT xH0, VALUE (L), VALUE (H)
F7
```

FIG. 5B

```
---Header data-------------
      4D 54 68 64          #'MThd'
      00 00 00 06          #Length=6
      00 00                #Format=0
      00 01                #Track=1
      01 E0                #Division=480

---Track data---------------- [01]
      4D 54 72 6B          #'MTrk'
      00 00 48 E5          #Length=18861

time   | event
-----------------------------------
     0 FF 51 03 07 53 00 # TEMPO
     1 F0 7E 7F 09 01 F7 # GM ON
   480 F0 43 71 7E 40    # FROM HERE, LIFTING RAIL NOTE-OFF MEASUREMENT VALUES
         15 28 33 2D     # VALUE OF KEY NO.1
         16 29 30 2C     # VALUE OF KEY NO.2
         17 2C 34 30     # VALUE OF KEY NO.3
           |                     |
         59 24 2E 29     # VALUE OF KEY NO.69
      F7                 # UP TO HERE, LIFTING RAIL NOTE-OFF MEASUREMENT VALUES
  1065 90 3C 4B          # NOTE-ON
  1066 90 40 44          # NOTE-ON
  1070 90 44 47          # NOTE-ON
  1155 B0 40 00          # DAMPER PEDAL
  1215 B0 40 0F          # DAMPER PEDAL
  1402 B0 40 26          # DAMPER PEDAL
  1432 B0 40 37          # DAMPER PEDAL
  1515 B0 40 45          # DAMPER PEDAL
  1545 B0 40 4C          # DAMPER PEDAL
  1575 B0 40 53          # DAMPER PEDAL
  1635 B0 40 60          # DAMPER PEDAL
  1762 B0 40 71          # DAMPER PEDAL
  1950 A0 3C 16          # RELEASE CONTROL
  1990 80 3C 2C          # NOTE OFF
  2005 80 44 36          # NOTE OFF
  2026 80 40 32          # NOTE OFF
  2160 B0 40 7C          # DAMPER PEDAL
  2235 B0 40 76          # DAMPER PEDAL
  2295 B0 40 6F          # DAMPER PEDAL
  2430 B0 40 63          # DAMPER PEDAL
  2565 B0 40 56          # DAMPER PEDAL
  2625 B0 40 4D          # DAMPER PEDAL
  2722 B0 40 3C          # DAMPER PEDAL
         |                     |
         |                     |
      FF 2F 00           # End of track
```

FIG. 11

KEYBOARD MUSICAL INSTRUMENT, AND METHOD FOR RECORDING HALF PERFORMANCE OF PEDAL OR KEY DAMPER ON KEYBOARD MUSICAL INSTRUMENT

BACKGROUND

The present invention relates generally to a keyboard musical instrument which detects and records performance operations of a pedal or keys, and more particularly to recording half performances of a pedal or keys taking into consideration key-specific damper half regions related to operations of the pedal and key-specific damper half regions related to operations of the keys.

Heretofore, it has been generally know that keyboard musical instruments, constructed to generate a tone in response to striking of a string set (comprising one or more strings), have, for each of keys, a damper that is brought into and out of contact with the corresponding string set. As well known, the keyboard musical instruments are provided with a loud pedal (damper pedal) for controlling behavior of the dampers. Generally, in a depression stroke of the loud pedal (damper pedal), there are three different regions: a "play region (or rest region)" where no influence of depression of the loud pedal is transmitted to the dampers; a half pedal region from a point where reduction of pressing contact force applied from the dampers to the string sets is started to a point where the dampers are brought out of contact with the string sets; and a "string-releasing region" where, following the above-mentioned half pedal region, the dampers are completely spaced from the string sets.

Also known are keyboard musical instruments which can be caused to execute an automatic performance, including pedal operation, by supplying a driving electric current to a solenoid coil to drive a pedal in accordance with performance data. In an automatic performance on such a keyboard musical instrument, it is desirable, particularly in order to enhance reproducibility of the performance, that appropriate control be performed on the loud pedal and the like to provide appropriate pedal operation matching the above-mentioned half pedal region. For example, in performing feedback control etc. of pedal operation on the basis of performance data, it would be important to properly identify the above-mentioned half pedal region and have the identified half pedal region reflected in the control.

Thus, there have heretofore been proposed methods or techniques for accurately and easily identifying a half pedal region and a half point present in that half pedal region. Japanese Patent No. 4524798, for example, discloses a technique for observing driving loads on a pedal to identify a half point of the pedal. Further, Japanese Patent Application Laid-open Publication No. 2007-292921 discloses detecting vibrations of a soundboard to identify a half point of the pedal.

Also known are keyboard musical instruments, such as auto-playing pianos (player pianos), which execute an automatic performance by driving a pedal and keys on the basis of automatic performance information. A half pedal region and half pedal point obtained or identified in the aforementioned manner can be advantageously used to execute on the keyboard musical instrument an automatic performance using half regions.

Also known are keyboard musical instruments which detect movement of a pedal and keys in a performance and record the performance as automatic performance information (see, for example, Japanese Patent No. 4305319). Another keyboard musical instrument can execute an automatic performance by driving a pedal and keys on the basis of the automatic performance information recorded on the above-mentioned keyboard musical instrument.

In recording of movement of the damper pedal with the conventionally-known technique, a value indicative of a half operation is recorded in response to the pedal passing through a particular stroke position predetermined as a half point. With such a conventionally-known technique, however, no consideration is taken of the fact that a half characteristic (half pedal region or half pedal point) of the pedal can differ among the keys (see the above-identified Japanese Patent No. 4524798 and Japanese Patent Application Laid-open Publication No. 2007-292921).

According to observations by the inventors of the present invention etc., an actual half characteristic of the pedal can differ among the keys. Namely, timing or pedal stroke position at which the dampers are brought out of or into contact with the corresponding string sets (i.e., string-releasing/string-contacting timing) in response to movement of the damper pedal can differ among the dampers. However, because all of the dampers are collectively or simultaneously driven by an operation of the pedal, the dampers cannot be controlled individually or independently of one another. When performing a half operation of the damper pedal in a manual performance, a human player may be performing the pedal half operation while intuitively grasping an overall half characteristic for all of the dampers of a plurality of keys. Thus, in a manual performance, the human player can perform an appropriate half operation while grasping an overall pedal half characteristic specific to the keyboard musical instrument he or she uses.

In an automatic performance executed on the keyboard musical instrument, on the other hand, no appropriate half operation can be played back or reproduced unless there is a match between a pedal stroke position indicated by half operation instructing data in automatic performance information and a pedal stroke position that permits appropriate recognition of an overall half characteristic on the keyboard musical instrument. As a prerequisite for that, the half operation instructing data in the automatic performance information itself has to appropriately correspond to the pedal half characteristic. Normally, automatic performance information is generated on the basis of a human player's actual manual performance on a keyboard musical instrument, as noted above. Therefore, in recording the automatic performance information generated on the basis of the human player's actual manual performance, half operation instructing data in the automatic performance information itself has to appropriately correspond to the pedal half characteristic.

Thus, in recording a pedal performance as automatic performance information, it is desirable that half performance operation data permitting recognition of an overall half characteristic for all of the dampers be recorded taking into consideration a half characteristic in a stroke of the damper pedal for the damper of each of the keys. The same is true regardless of whether the half characteristic is defined by a half pedal point or a half pedal region.

Further, in recording of movement of the keys, for each of the keys, a value indicative of a half operation (i.e., indicative of that the key has passed through a half region or half point) is recorded in response to the key having passed through a predetermined key stroke position. However, in the automatic performance information recorded in accordance with the conventionally-known technique, a half characteristic (key-damper half region or key-damper half point) does not differ among the keys, and a key-damper half characteristic in a key stroke is defined in a uniform value for each of the keys.

Further, according to observations by the inventors of the present invention etc., an actual half characteristic of the keys can differ among the keys. Namely, timing or key stroke position at which the corresponding damper is brought out of or into contact with the corresponding string set (i.e., string-releasing/string-contacting movement timing) in response to movement of the key can differ among the dampers. In this case too, a human player in a manual performance may be performing half operations with subtle key-specific differences while instinctively grasping half characteristics specific to the keys.

In an automatic performance executed on the keyboard musical instrument, however, no appropriate key-damper half operation can be reproduced unless a key stroke position indicated by uniform key half operation instructing data in automatic performance information and a key stroke position that permits appropriate recognition of a key-specific half characteristic on the keyboard musical instrument match each other. As a prerequisite for that, key half operation instructing data in the automatic performance information itself has to appropriately correspond to a half characteristic of each of the key dampers. Normally, automatic performance information is generated on the basis of a human player's actual manual performance on a keyboard musical instrument, as noted above. Therefore, in recording the automatic performance information generated on the basis of the human player's actual manual performance, key half operation instructing data in the automatic performance information itself has to appropriately correspond to the pedal half characteristic of each of the key dampers.

Thus, in recording a key performance as automatic performance information, it is desirable that key half performance operation data specific to the individual keys on the keyboard musical instrument be recorded taking into consideration a half characteristic, in a key stroke, of the damper for each of the keys. The same is true regardless of whether the half characteristic of the key is defined by a key-damper half pedal point or a key-damper half pedal region.

SUMMARY OF THE INVENTION

In view of the foregoing prior art problems, the present invention seeks to provide an improved keyboard musical instrument which can record automatic performance information that allows string-releasing/string-contacting movement of dampers in a performance to be appropriately reproduced on another keyboard musical instrument, as well as an improved method therefor.

In order to accomplish the above-mentioned object, the present invention provides an improved keyboard musical instrument, which comprises: a plurality of keys each configured to control generation and deadening of a corresponding sound in response to an operation of the key; a plurality of dampers each provided in corresponding relation to any one of the keys and configured to be driven, in response to an operation of the corresponding key, to control deadening of a sound corresponding to the key; a pedal configured to collectively drive the plurality of dampers; an acquisition section configured to acquire information identifying one half region or half point in a stroke of the pedal, the one half region or half point being determined on the basis of a plurality of half pedal regions or half pedal points, in the stroke of the pedal, specific to individual ones of the dampers; a sensor configured to detect a stroke position of the pedal; a performance data generation section configured to generate performance data including data instructing a pedal operation, on the basis of the one half region or half point identified by the information and the stroke position detected by the sensor; and a recording section configured to record the performance data including data instructing a pedal operation generated by the performance data generation section.

The present invention is characterized in that the one half region or half point in the stroke of the pedal identified by the information acquired by the acquisition section is determined on the basis of the plurality of half pedal regions or half pedal points in the stroke of the pedal specific to the individual dampers. Thus, the one half region or half point identified by the information can present an overall half characteristic for the dampers of the plurality of keys with a half characteristic in the pedal stroke taken into account for each of the dampers and thus appropriately indicates a half characteristic of the pedal of the keyboard musical instrument of the invention. Therefore, by generating and recording the performance data including data instructing a pedal operation on the basis of the one half region or half point identified by that information and the stroke position detected by the sensor, the present invention can record, as standard data for automatic performance, performance data appropriately corresponding to a pedal half characteristic. In this manner, the present invention can record automatic performance information that allows string-releasing/string-contacting movement of dampers, obtained through a pedal half operation performed for a recording purpose, to be appropriately reproduced on another keyboard musical instrument.

In an embodiment, the acquisition section may be configured to: reference the plurality of half pedal regions or half pedal points specific to the individual dampers acquired in advance; and determine the one half region or half point on the basis of on the referenced plurality of half pedal regions or half pedal points specific to the individual dampers.

Further, the one half region may be determined on the basis of a depression-end-side end position closest to a depression end of the pedal among depression-end-side end positions in the plurality of half pedal regions specific to the individual dampers and a rest-position-side end position closest to a rest position of the pedal among rest-position-side end positions in the plurality of half pedal regions.

In an embodiment, the acquisition section includes a memory storing the information identifying the one half region or half point determined in advance on the basis of the plurality of half pedal regions or half pedal points specific to the individual dampers.

According to another aspect of the present invention, there is provided an improved keyboard musical instrument, which comprises: a plurality of keys each configured to control generation and deadening of a corresponding sound in response to an operation of the key; a plurality of dampers each provided in corresponding relation to any one of the keys and configured to be driven, in response to an operation of the corresponding key, to control deadening of a sound corresponding to the key; an acquisition section configured to acquire, for each of the plurality of keys, information identifying a key-damper half region or key-damper half point in a stroke of the key; detectors provided in corresponding relation to the plurality of keys and each configured to detect a stroke position of a corresponding one of the keys; a performance data generation section configured to generate performance data including data instructing key operations, on the basis of on the stroke positions of the keys detected by the detectors and the key-damper half regions or key-damper half points specific to the keys; and a recording section configured to record the performance data including data instructing key operations data generated by the performance data generation section.

Therefore, by generating and recording the performance data including data instructing key operations on the basis of the key-damper half regions or key-damper half points specific to the keys and stroke positions of the keys detected by the detectors, the present invention can record, as standard automatic performance data, performance data appropriately corresponding to half characteristics of the individual keys. In this manner, the present invention can record automatic performance information that allows string-releasing/sting-contacting movement of the dampers, obtained through key-damper half operations performed for a recording purpose, to be appropriately reproduced on another keyboard.

In an embodiment, when the stroke position of the key detected at least by any one of the detectors is related to the key-damper half region or key-damper half point specific to the key, the performance data generation section may generate the performance data including normalized data instructing a key operation related to a key-damper half region or key-damper half point.

In an embodiment, the performance data generation section may generate, as the normalized data, key-off event data instructing key release in response to the stroke position, during key release, of the key having passed through a predetermined key-off position set within the key-damper half region specific to the key.

In an embodiment, the performance data generation section may generate, as the normalized data, data instructing a half performance operation of a key in response to the stroke position, during key release, of the key having stayed for a predetermined time or longer within a predetermined release control region set within the key-damper half region specific to the key.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program. Note that, in this specification, the terms "sound" and "tone" are used interchangeably with each other.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which;

FIGS. 5A and 5B are diagrams showing example formats of the half information of the pedal;

FIG. 11 is a diagram showing an example format of an automatic performance data set;

(a) of FIG. 12 is a flow chart of pedal trajectory generation processing, and (b) of FIG. 12 is a flow chart of lifting rail note-off reception processing.

DETAILED DESCRIPTION

Figure 1:
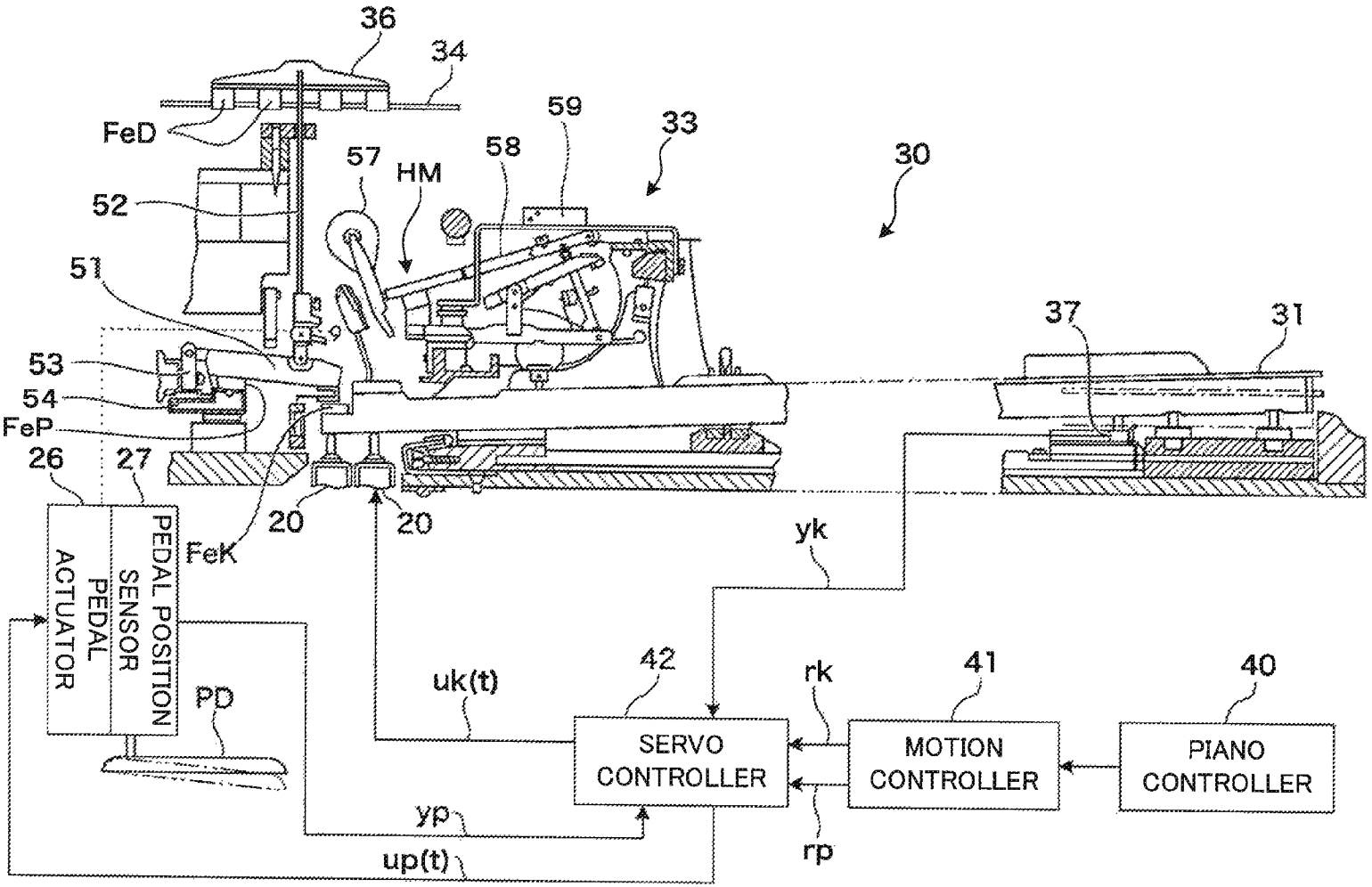
FIG. 1 is a partly sectional view showing a construction of a keyboard musical instrument having applied thereto an apparatus for identifying a key-damper half region according to an embodiment of the present invention, which particularly shows the keyboard musical instrument construction in relation to a given key.

FIG. 1 is a partly sectional view showing a construction of a keyboard musical instrument 30 in relation to a given single key. The keyboard musical instrument 30 is constructed as an auto-playing piano (player piano). Like an ordinary acoustic piano, the keyboard musical instrument 30 includes, for each of a plurality of keys 31, an action mechanism 33 for transmitting motion or movement of the key 31 to a hammer HM; a string set 34, comprising one or more strings (sounding elements), to be struck by the hammer HM; and a damper 36 for stopping vibrations of the string set 34. Note, however, that such dampers 36 are not provided for keys 31 in a predetermined high pitch range.

A plurality of the keys 31 are arranged side by side in a left-right direction. The hammers HM and action mechanisms 33 are provided in corresponding relation to the keys 31. A side of the keys 31 closer to a human player will hereinafter referred to as "front". Each of the hammers HM includes a hammer shank 58 and a hammer head 57 and pivots in response to depression of the corresponding key 31 so that the hammer head 57 strikes the corresponding string set 34 to generate a tone or sound.

In the keyboard musical instrument 30, a key drive unit 20 is provided for each of the keys 31 and located beneath a rear end portion of the key 31. Further, a key sensor unit 37 is provided for each of the keys 31 and located beneath a front end portion of the key 31, and the key sensor unit 37 continuously detects a stroke position of the key 31 during depression and release operations of the key 31 to thereby output a detection signal (yk) corresponding to a result of the detection.

A sensor applied to the key sensor unit 37 includes, for example, a light emitting diode (LED), a light sensor for receiving light emitted from the light emitting diode to thereby output a detection signal corresponding to an amount of the received light; and a light blocking plate for changing an amount of light to be received by the light sensor in accordance with a depressed amount of the key 31. The detection signal (yk) which is an analog signal output from the key sensor unit 37 is converted into a digital signal via a not-shown AD converter and then supplied to a servo controller 42.

Further, hammer sensors 59 are provided in corresponding relation to the hammers HM. Each of the hammer sensors 59 is disposed at a position of the hammer shank 58 of the hammer HM having reached near its forward pivot end position. The hammer sensor 59 may be generally similar in construction to a sensor applied to the key sensor unit 37. The hammer sensor 59 detects passage of the hammer shank 58 to continuously detect a position of the hammer HM, so that it outputs a detection signal corresponding to a result of the detection.

Note that the key sensor units 37 and the hammer sensors 59 may comprise any desired types of sensors as long as they can continuously detect positions or speeds or velocities of the keys 31 and hammers HM.

Once a drive signal is supplied to the key drive unit 20 of a key corresponding to a sound or tone pitch defined by note-on event data included in automatic performance data (automatic performance information), a plunger of the key drive unit 20 ascends to push up a rear end portion of the corresponding key 31. Thus, the key 31 is automatically depressed and the string set 34 corresponding to the depressed key 31 is struck by the hammer HM, so that a piano tone or sound is automatically generated.

The keyboard musical instrument 30 also includes: a pedal PD that is a loud pedal (damper pedal) for driving the dampers 36; a pedal actuator 26 for driving the pedal PD; and a pedal position sensor 27 for detecting a position of the pedal PD. The pedal position sensor 27 may be of a generally similar construction to the sensor applied to the key sensor unit 37. The pedal actuator 26 includes a solenoid and a plunger (not shown) connected to the pedal PD, and it is constructed in such a manner that, once a drive signal is supplied, the plunger moves to drive the pedal PD so that the pedal PD can be automatically depressed and released.

Except for the predetermined high pitch range, the dampers 36 are provided in corresponding relation to the keys 31. A damper wire 52 is connected to a front portion of the damper lever 51, and the damper 36 is provided on an upper end portion of the damper wire 52. The damper 36 has damper felts FeD (hereinafter referred to as "damper felt FeD") that are provided on its underside and brought into and out of contact with the string set 34. Once the pedal PD is depressed, all of the dampers 36 together move upward or ascend. But, when the pedal PD is not in the depressed state, only the damper 36 corresponding to a depressed key 31 ascends and then descends to its original position in response to release of the corresponding key 31. Namely, the damper 36 is constructed to activate its damping action on the corresponding key 31 (i.e., on vibrations of the string set 34) in response to release of the key 31 and cancel or deactivate its damping action in response to depression of the key 31. Further, the damper pedal PD is constructed to be capable of collectively deactivating or canceling effectiveness of the damping action of the plurality of dampers 36.

Mechanisms related to the dampers 36 may be of the well-known type. As an example, in a region rearward of the key 31, a damper lever 51 is pivotably supported at its rear end portion on a damper lever flange 53 fixed to the keyboard musical instrument 30, a damper wire 52 is connected to a front portion of the damper lever 51. These mechanisms 51, 52, 53, etc. are provided independently for each of the keys 31 for driving the corresponding damper 36. By contrast, the loud pedal PD for collectively driving the dampers 36 of the individual keys 31 and a lifting rail 54 operating in interlocked relation to an operation of the pedal RD are provided for shared use among the individual keys 31. Namely, the single lifting rail 54 extending in a substantially horizontal direction across all of the keys 31 is disposed beneath the damper levers 51 of the individual keys 31. The lifting rail 54 is connected to and supported by the pedal PD via a knot-shown thrust-up rod. As the pedal PD is depressed, the thrust-up rod moves upward, in response to which the lifting rail 54 too moves upward. Then, as the depression of the pedal PD is canceled, the thrust-up rod returns downward, in response to which the lifting rail 54 too returns downward.

A damper lever felt FeP is provided on the upper surface of the lifting rail 54. As the lifting rail 54 moves upward, the damper lever felt FeP drives the damper lever 51, so that the damper lever 51 pivots in a counterclockwise direction of FIG. 1. In this manner, all of the dampers 36 ascend via the damper wires 52, so that all of the damper felts FeD together get out of contact with the corresponding string sets 34. As set forth above in the introductory part of this specification, the single lifting rail 54, moving vertically (in an up-down direction) in interlocked relation to depression of the pedal PD, may not always extend in a complete horizontal direction and there tend to be some variation or unevenness among mechanisms related to the dampers 36 of the individual keys 31, because of which relationship between a depressed position of the pedal PD and operating positions of the dampers 36 of the individual keys 31 (e.g., timing at which the individual damper felts FeD are brought out of or into contact with the corresponding string sets 34) would differ among the keys 31.

A damper lever cushion felt (hereinafter referred to as "key felt FeK") is provided on an upper rear end portion of the key 31. In a non-key-depressed state, the damper felt FeD is held in abutting contact with the string set 34 by the own weight of the damper 36. Once the key is depressed, the corresponding key felt FeK drives the damper lever 51 so that the damper lever 51 pivots in the counterclockwise direction of FIG. 1. Thus, the corresponding damper 36 ascends via the damper wire 52, so that the damper felt FeD of the damper 36 is brought out of contact with the string set 34.

Further, the keyboard musical instrument 30 includes, for execution of an automatic performance, a piano controller 40, a motion controller 41 and the servo controller 42. The piano controller 40 supplies automatic performance data to the motion controller 41. The performance data comprise, for example, MIDI (Musical Instrument Digital Interface) codes and may include key drive data that specifically defines, for each of the keys 31, time-vs.-position relationship during depression and release strokes of the key 31. The performance data may also include pedal drive data that specifically defines time-vs.-position relationship during a depression stroke of the pedal PD. The motion controller 41 is constructed to generate, on the basis of the pedal drive data and pedal drive data included in the supplied performance data, target position data rp and rk indicative of respective target positions of the shift pedal PD and keys 31 momently changing with respect to time t and supply the generated target position data rp and rk to the servo controller 42. Meanwhile, a detection signal of the pedal position sensor 27 is supplied as a feedback signal yp to the servo controller 42, and similarly a detection signal of the key sensor unit 37 is supplied as a feedback signal yk to the servo controller 42. Note that a signal output from the solenoid 20*a* of the key drive unit 20 may be used as the above-mentioned feedback signal yk.

The servo controller 42 generates, for each of the pedal PD and keys 31, an energizing electric current instructing value up(t), uk(t) corresponding to a deviation between the target position data rp, rk and the feedback signal yp, yk, and it supplies the thus-generated electric current instructing values up(t) and uk(t) to the pedal actuator 26 and the key drive unit 20, respectively. For example, the energizing electric current instructing values up(t) and uk(t) are indicative of average energizing electric currents to be fed to the solenoid coils of the pedal actuator 26 and the key drive unit 20, respectively. Actually, these energizing electric current instructing values up(t) and uk(t) may each be in the form of a PWM signal having been subjected to pulse width modulation in such a manner as to have a duty ratio corresponding to the average energizing electric current.

In an automatic performance based on the automatic performance data, the servo controller 42 performs servo control by comparing corresponding ones of the target position data rp and rk and the feedback signals yp and yk and outputting the electric current instructing values up(t) and uk(t) after updating the same as necessary in accordance with deviations between the compared data rp and rk and the feedback signals yp and yk so that the feedback values reach the corresponding target values. In this way, the automatic performance is executed by the shift pedal PD and the keys 31 being driven in accordance with the performance data.

Figure 2:
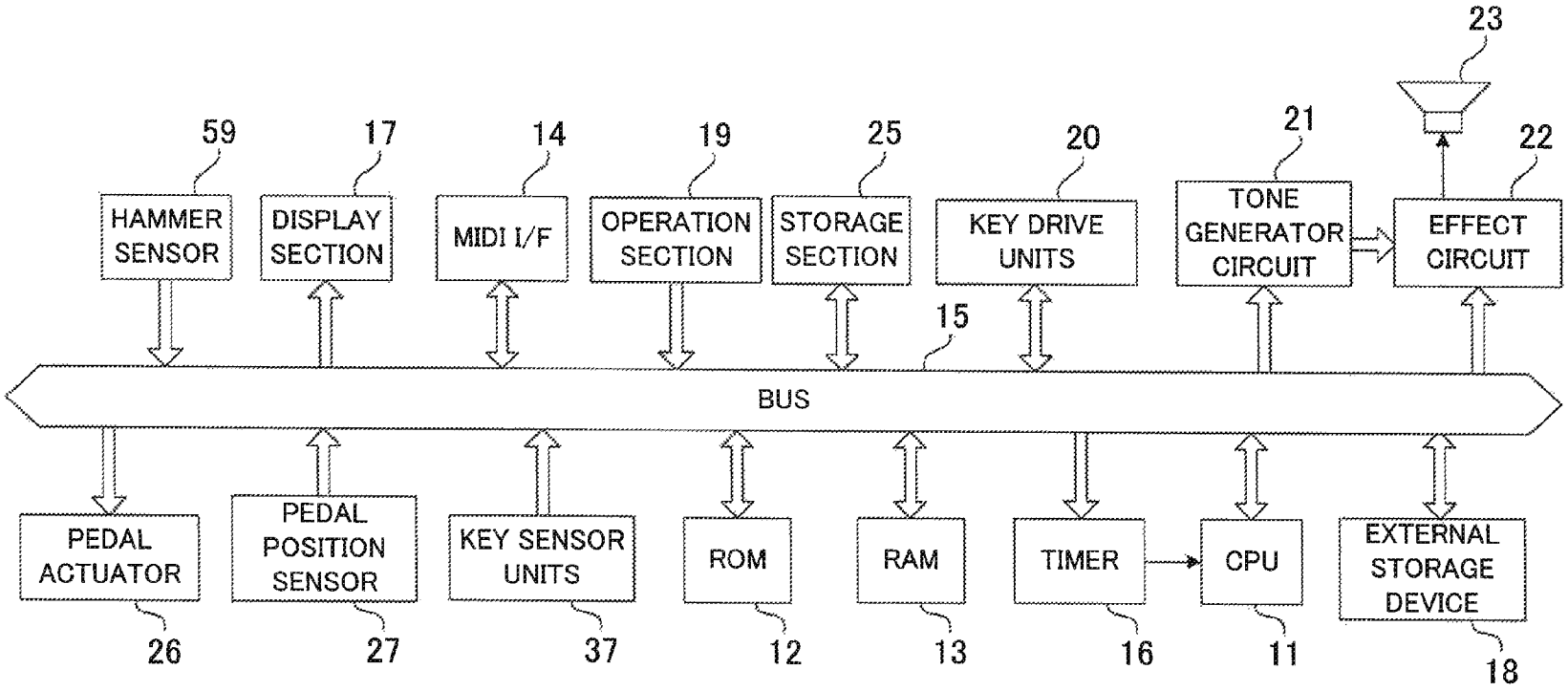
FIG. 2 is a block diagram showing an example hardware construction of a control device of the keyboard musical instrument.

FIG. 2 is a block diagram showing an example hardware construction of a control device for the keyboard musical instrument 30. The control device for the keyboard musical instrument 30 includes a CPU 11 to which are connected, via a bus 15, the aforementioned key drive units 20, the petal actuator 26, the pedal position sensor 27, the key sensor units 37, the hammer sensor 59, a ROM 12, a RAM 13, an interface unit 14, a timer 16, a display section 17, an external storage device 18, an operation section 19, a tone generator circuit 21, an effect circuit 22 and a storage section 25. A sound system 23 is connected via the effect circuit 22 to the tone generator circuit 21.

The CPU 11 controls the entire keyboard musical instrument 30. The ROM 12 stores therein control programs for execution by the CPU 11 and various data, such as table data. The RAM 13 temporarily stores therein, among other things, various input information, such as performance data and text data, various flags, buffered data and results of arithmetic operations. The interface (I/F) unit 14, which is a MIDI interface, communicates, as MIDI signals, automatic performance data to not-shown MIDI equipment or the like and communicates automatic performance data via a network interface. The timer 16 counts interrupt times in timer interrupt processes and various time lengths. The display section 17 includes, for example, an LCD and displays various information, such as a musical score. The external storage device 18 is constructed to be capable of accessing a not-shown portable storage medium, such as a flexible disk and reading and writing data, such as performance data, from and to the portable storage medium. The operation section 19, which includes not-shown operators (input members) of various types, is operable to instruct a start/stop of an automatic performance, instruct selection of a music piece etc. and make various settings. The storage section 25, which comprises a non-volatile memory, such as a flash memory or hard disk, can store various data, such as automatic performance data. Application programs for allowing a computer to execute a method for identifying a damper pedal region in accordance with an embodiment of the present invention is stored in a non-transitory computer-readable storage medium, such as the ROM 12 or storage section 25, and such an application program is executable by the CPU 11.

The tone generator circuit 21 converts performance data into tone signals. The effect circuit 22 imparts various effects to the tone signals input from the tone generator circuit 21, and the sound system 23, which includes a D/A (Digital-to-Analog) converter, amplifier, speaker, etc., converts the tone signals and the like input from the effect circuit 22 into audible sounds.

Note that the functions of the motion controller 41 and the servo controller 42 are actually implemented through cooperation among the CPU 11, timer 16, ROM 12, RAM 13, etc. and the application program. Signals of various kinds of sensors are supplied to the CPU 11 via not-shown A/D converters.

In a forward stroke of key depression (i.e., key-depressing forward stroke), there exist three different regions: a "play region (or rest region)" where no influence of the key depression is transmitted to the damper 36; a "half region" from a point where reduction of pressing contact of the damper 36 against the string set 34 is started to a point where the damper 37 is brought out of contact with the string set 34; and a "string-releasing region" where, following the above-mentioned half region, the damper 36 is completely spaced away from the string set 34. In a depression stroke of the pedal PD too, there exist three similar regions, idle region, half region and string-releasing region.

The half region in relationship between each of the keys 31 and the damper 36 corresponding to the key 31 will hereinafter be referred to as "key-damper half region", while the half region in relationship between the pedal PD and each of the dampers 36 will hereinafter be referred to as "half pedal region". Such a key-damper half region can be defined uniquely per key 31 in relation to stroke positions of the key 31. Briefly, the "key-damper half region" can be defined as an operating region where neither effectiveness of the damper 36 or cancellation of the effectiveness of the damper 36 responsive to an operation of the key 31 is sufficient.

Timing at which the dampers 36 are brought out of and into contact with the string sets in response to an operation of the pedal PD may differ among the dampers 36. The "half pedal region" in relationship between the pedal PD and each of the dampers 36 is a concept derived when all of the dampers 36 are regarded as operating integrally; and the human player operates the pedal PD while instinctively grasping one overall half characteristic for the dampers 36 of the plurality of keys. Note that the "half pedal region" can be briefly defined as an operating region of the pedal PD where neither the effectiveness of the damper 36 nor cancellation of the effectiveness of the damper 36 responsive to an operation of the pedal PD is sufficient. In the instant embodiment, the half pedal region of the pedal PD can be uniquely defined for each of the keys in relation to a position of the one pedal PD that can commonly act on the dampers 36 of all of the keys 31.

Assuming that the half pedal region, if considered precisely, can differ among the dampers 36, a start point, in the depressing stroke of the pedal PD, of the half pedal region may be considered to exist between a point when the first one of the dampers 36 starts to be driven via the lifting rail 54 and a point when the last one of the dampers 36 starts to be driven via the lifting rail 54. Further, an end point of the half pedal region may be considered to exist between a point when the first one of the dampers 36 releases the string set and a point when the last one of the dampers 36 releases the string set.

As a matter of fact, the lifting rail 54 elongated in a horizontal or left-right direction is supported at its portion connected with the pedal PD and cantilevered at the supported portion, so that flexural deformation may occur in the lifting rail 54 and hence the lifting rail 54 may not necessarily lie in an exact horizontal direction. Therefore, strictly speaking, the lifting rail 54 may undesirably differ in vertical (height) position depending on its portions in the horizontal, left-right direction, and thus, the start and end points of the half pedal region can differ among the dampers 36 of the individual keys. Thus, variation in position and dimensions among the dampers 36 and variation in resiliency of the damper lever felt FeD and damper lever felt FeP would also influence the half pedal region.

Further, the key-damper half region too differs subtly from one key 31 to another, as noted above. Let it be assumed that, in the instant embodiment, both half information 71 (FIGS. 3 and 7) defining a half pedal region, related to pedal stroke positions, individually for each of the dampers 36 and half information 76 (FIGS. 4 and 7) defining a key-damper half region, related to key stroke positions, individually for each of the dampers 36 has already been acquired through measurement or the like and prestored in the ROM 12 or the like.

Figure 3:
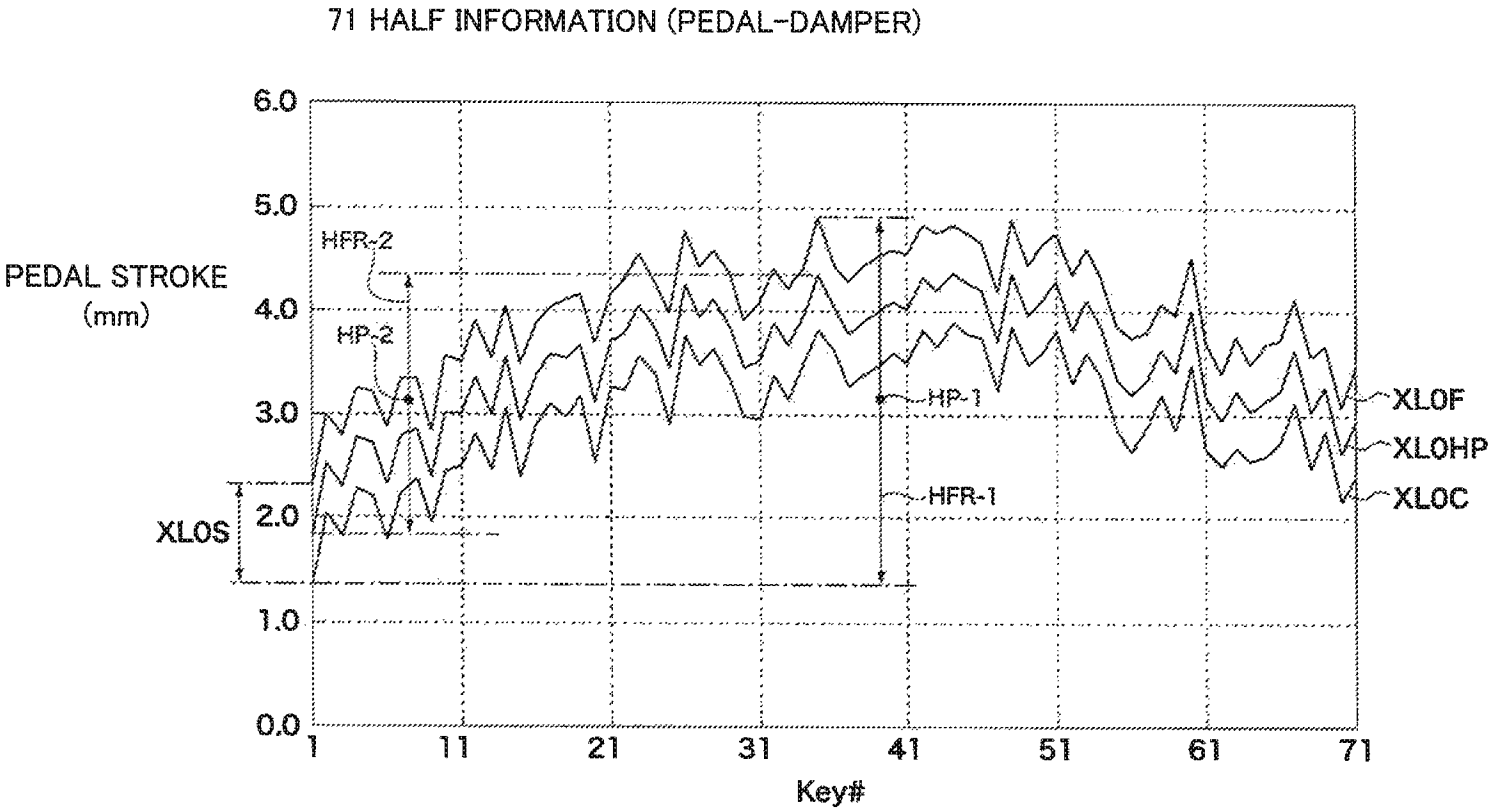
FIG. 3 is a conceptual diagram of half information indicative of a distribution of half pedal regions for individual dampers in relationship between a pedal and the dampers.

FIG. 3 is a conceptual diagram of the half information 71 indicative of a distribution of half pedal regions XL0S of the dampers 36 of the individual keys 31 in relationship between the pedal PD and the dampers 36, where the horizontal axis represents key numbers of the individual keys 31 while the vertical axis represents pedal stroke positions (mm). For each of the dampers 36, the half pedal region XL0S lies from a half pedal region start point XL0C to a half pedal region end point XL0F.

For identifying the half pedal region XL0S, it is preferable that a portion of the pedal PD or other element operating in interlocked relation to the pedal PD be determined in advance as a particular portion to be used for expressing (measuring) a pedal stroke. For example, in the instant embodiment, an upper end position of the lifting rail 54 is determined as the particular portion. Thus, let it be assumed here that a specific numerical value indicative of the half pedal region XL0S is expressed as an amount (mm) of displacement, in the pedal-depressing (forward) direction from a rest position (non-pedal-depressed position) of the pedal PD, of the particular portion. Alternatively, however, any other desired portion, such as a distal end portion of the pedal PD, may be determined or set as the particular portion to be used for expressing (measuring) a pedal stroke. A height position of the particular portion moved or displaced in response to a depression operation will sometimes be referred to also as "pedal position" for convenience of description.

As will be described later, the half information 71 of the pedal PD shown in FIG. 3 is referenced by a half information reference section 72 (FIG. 7), and a half region determination section 73 (FIG. 7) determines, on the basis of the half information 71, determines a single half region (common half region) in the pedal stroke. This half region represents a region recognized as a single overall half characteristic, not on a damper-specific basis, at the time of a pedal operation. A means for determining such a half region is not limited to just one means; for example, such a half region may be determined on the basis of a depression-end-side end position closest to the depression end of the pedal PD among depression-end-side end positions in half pedal regions corresponding to the individual dampers 36 and a rest-position-side end position closest to the rest position of the pedal PD among rest-position-side end positions in the half pedal regions corresponding to the individual dampers 36. For example, such a pedal region may be determined on the basis of an average value of information of all of the dampers 36 or information of the dampers 36 in a partial low pitch range, on the basis of the smallest depression depth among all of the dampers 36 or information of the dampers 36 in the partial low pitch range, or the like. In the illustrated example of FIG. 3, the half region is a range indicated by HFR-1, and the half point of the half region HFR-1 is a point HP-1 that divides the range HFR-1 with a predetermined internal division ratio (e.g., 1:1).

Note that the already-acquired half information 71 of the pedal PD for the individual keys 31 is not necessarily limited to information defined by the half pedal regions XL0S and may be information where a half pedal point XL0HP is defined for each of the dampers 36 as also shown in FIG. 3. In such a case, the above-mentioned single half region (common half region) in the pedal stroke is determined on the basis of maximum and minimum values of all of the half pedal points XL0HP like the one indicated by HFR-2 in FIG. 3, and the half region HFR-2 has a half pedal point HP-2 that divides the half region HFR-2 with a predetermined internal division ratio (e.g., 1:1).

As noted above, the half information 71 includes a plurality of half pedal regions XL0S or half pedal points XL0HP in the stroke of the pedal PD that are unique or specific to the individual dampers 36. Further, the single half region (common half region) HFR-1 or HFR-2 or the half pedal point HP-1 or HP-2 determined by the half region determination section 73 identifies a single half region or half point in the stroke of the pedal PD.

Thus, a combination of the half information reference section 72 for referencing the half information 71 and the half region determination section 73 functions as an acquisition section that acquires information identifying the single half region (HFR-1 or HFR-2) or half point (HP-1 or HP-2) in the stroke of the pedal PD. Note that such an acquisition section need not necessarily comprise a combination of the half information reference section 72 and the half region determination section 73 and may comprise a memory having stored therein information identifying the single half region (HFR-1 or HFR-2) or half point (HP-1 or HP-2) predetermined on the basis of the plurality of half pedal regions XL0S or half pedal points XL0HP unique or specific to the individual dampers 36.

Figure 4:
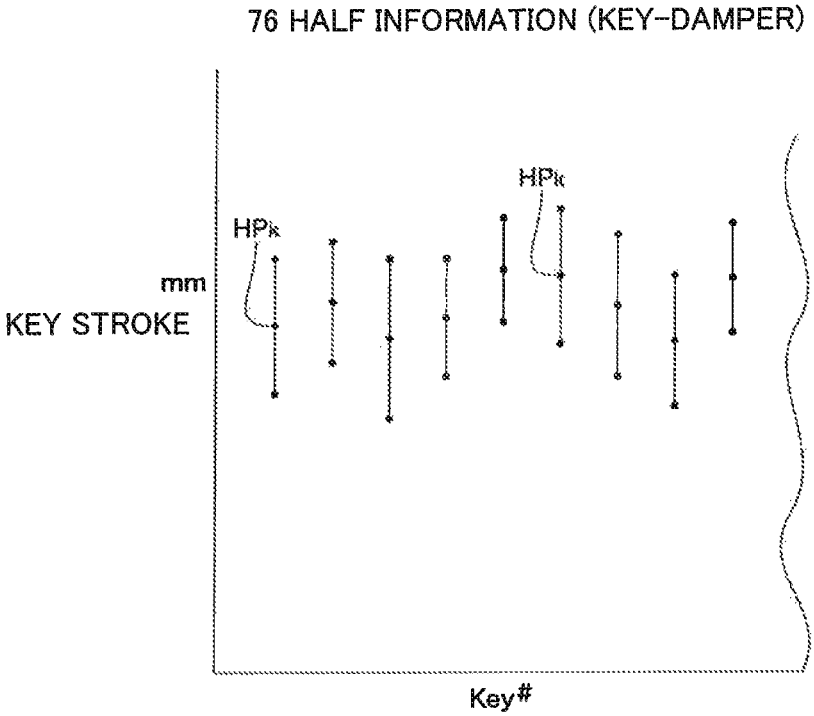
FIG. 4 is a conceptual diagram of half information showing a part of distribution of key-damper half regions in relationship between individual keys and the corresponding dampers.

It should be noted that specific embodiments of the technique for acquiring the half information 71 of the pedal PD for the individual keys 31 are disclosed in a U.S. patent application Ser. No. 14/250,930, entitled "Method and Apparatus for Identifying Half Pedal Region in Keyboard Musical Instrument," filed Apr. 11, 2014, now U.S. Pat. No. 8,933,316, issued Jan. 13, 2015, which is based on, and claims priority to, Japanese patent application No 2013-082849 filed on 11 Apr. 2013, the entire contents of which are incorporated herein by reference, FIG. 4 is a conceptual diagram of the half information 76 showing a part of distribution of key-damper half regions in relationship between the individual keys 31 and the corresponding dampers 36, where the horizontal axis represents key numbers of the individual keys 31 while the vertical axis represents key stroke positions (mm). The key-damper half region differs among the keys 31 and hence the dampers 36.

It is preferable that a portion of the key 31 that is normally depressed with a human player's finger be set as a particular portion in identifying a stroke position of the key 31 (key stroke position). Let it be assumed here that the key-damper half region is expressed as an amount (mm) of movement or displacement of the particular portion in the key-depressing forward direction from a rest position (non-depressed position). Note, however, that any other desired portion, such as a rear end portion, of the key 31 may be set as that particular portion in identifying (measuring) a key stroke position.

Further, a key-damper half point HPk within the key-damper half region is identified for each of the keys 31. Such a key-damper half point HPk is set as a point that divides the key-damper half region of the key 31 with a predetermined inner division ratio 1:1).

Note that the already-acquired half information 76 of the keys 31 is not necessarily limited to information defined by the key-damper half regions and may be information where a key-damper half point HPk is defined for each of the keys 31.

As noted above, the half information 76 is information identifying, for each of the plurality of keys 31, the key-damper half region or the key-damper half point HPk in the stroke of the key 31, and the half information 76 is referenced by the half information reference section 72 as will be described later. Thus, the construction where the half information reference section 72 references the half information 76 functions as an acquisition section that acquires information identifying the key-damper half region or the key-damper half point HPk in the stroke of the key 31.

FIGS. 5A and 5B are diagrams showing example formats of the half information 71 (FIG. 3) of the pedal PD for the individual keys 31.

In the half information 71 (FIG. 3) of the pedal PD, as shown in FIG. 5A, a floor point (half pedal region start point XL0C), ceiling point (half pedal region end point XL0F) and half point (half pedal point XL0HP) are recorded for each of the dampers 36 across the distribution. A half pedal region XL0S is defined with the floor point and ceiling point. Alternatively, if the half pedal region is expressed by quadratic function approximation as illustratively shown in FIG. 5B, coefficients may be recorded.

In recording of the half information 76 (FIG. 4) of the individual keys 31 too, a format similar to that of the half information 71 of the pedal PD may be employed.

Figure 6:
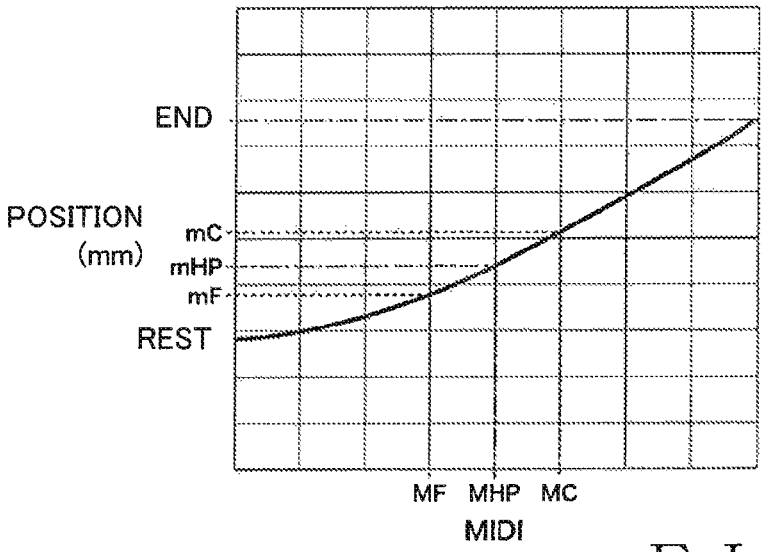
FIG. 6 is a diagram showing conversion information (conversion table) for associating local half regions specific to the pedal of the keyboard musical instrument with standard half regions defined in automatic performance data.
Figure 7:
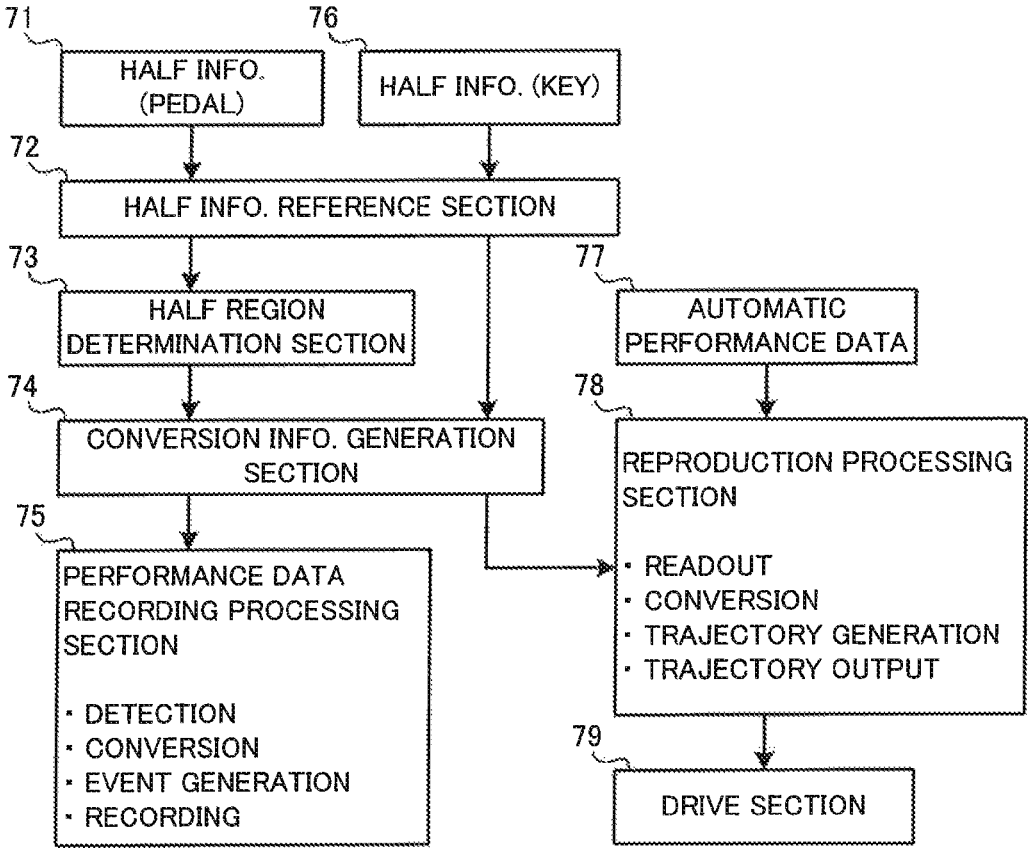
FIG. 7 is a block diagram showing functional arrangements for executing an automatic performance (reproduction) and performance data recording on the keyboard musical instrument.

FIG. 6 is a diagram showing conversion information (conversion table) for the pedal PD defining correspondency relationship between pedal stroke positions specific to the pedal PD and predetermined standard pedal stroke positions, such as MIDI pedal stroke positions. Further, FIG. 7 is a block diagram showing functional arrangements for executing an automatic performance and processing for recording performance data on the keyboard musical instrument 30.

As partly described above, the instant embodiment of the keyboard musical instrument executes an automatic performance by automatically operating the pedal PD and the keys 31 on the basis of a set of automatic performance data (automatic performance data set) 77 that is automatic performance information for playing back a desired music piece or a phrase. Here, the automatic performance data set 77 is data recorded, for example, in a format illustratively shown in FIG. 11. Note, however, that automatic performance data to be employed in the instant embodiment may be known commercially-available music piece performance data. The automatic performance data set 77 to be used in reproduction processing (automatic performance processing) may be a set of data recorded by performing actual key and pedal operations on the instant embodiment of the keyboard musical instrument 30, data recorded by performing actual key and pedal operations on another keyboard musical instrument, or data created through data input processing or the like without actual key and pedal operations being performed.

The automatic performance data set 77 includes data instructing operations of the pedal PD and the keys 31. As an example, the data instructing an operation of the pedal PD is information (pedal reproduction event) indicating, in standard values, a time series of stroke positions in the depressing and releasing strokes of the pedal PD, in which half regions and/or half points of the pedal PD are expressed in standard values. Further, for example, the data instructing operations of the keys 31 includes, in addition to information identifying each key to be depressed or released (note-on event or note-off event), information identifying each key to be controlled to be positioned at a key-damper half region or key-damper half point (e.g., key release control event).

First, for example, a region from a half start point MF defined as a standard MIDI value to a half end point MC defined as a standard MIDI value is set as a half pedal region (standard MIDI half pedal region) of the pedal PD (see the horizontal axis of FIG. 6). Data instructing an operation of the pedal PD is defined in accordance with a numerical value representative of the standard MIDI half pedal region. On the other hand, the single (common) half region in the pedal stroke specific to the pedal PD of the keyboard musical instrument 30, determined by the half region determination section 73 on the basis of the half information 71, is a region from a half start point mF defined as a stroke position (mm) to a half end position mC defined as a stroke position (mm) (see the vertical axis of FIG. 6).

The conversion information (conversion table) for the pedal PD shown in FIG. 6 is information for use in an automatic performance (reproduction) and performance data recording related to the pedal PD so as to perform data conversion (localization or normalization) between the standard half region in automatic performance data and the haft region specific to the pedal PD of the keyboard musical instrument 30. Namely, the conversion information shown in FIG. 6 is a table for associating the half region determined by the half region determination section 73 and specific to the pedal PD of the keyboard musical instrument 30 (i.e., local half region) with a standard half region in the automatic performance data (i.e., normalized half region). Such conversion information (conversion table) shown in FIG. 6 is prepared or created or generated in a conversion information generation section 74 (FIG. 7).

More specifically, as shown in FIG. 6, the half start point mF corresponds to the half start point MF, the half end point mC corresponds to the half end point MC, and the half point mHP corresponds to the half point MHP. Further, local and standard half regions and pedal stroke positions are also defined to correspond to each other in accordance with such half start points, half end points and half points.

Thus, when a pedal reproduction event (pedal operation instructing data), indicating the half start point MF is being output from the automatic performance data set 77, the pedal PD of the keyboard musical instrument 30 is controlled to be positioned at the half start point mF. A value of the local half start point mF corresponding to the standard half start point MF is unique or specific to the keyboard musical instrument 30 and determined on the basis of the half information 71. Likewise, the local half end point mC and the half point mHP are determined on the basis of the half information 71.

Although a conversion table for conversion between a standard key-damper half region or key-damper half point and a local key-damper half region or key-damper half point for each of the keys 31 is not particularly shown, conversion information (conversion table for key-damper half region) similar in construction to the conversion table of FIG. 6 is prepared or created or generated in the conversion information generation section 74 (FIG. 7) for each of the keys 31, i.e. for each of the dampers 36, and this conversion information (conversion table for key-damper half region) is used in an automatic performance (reproduction) and performance data recording related to the keys 31. Namely, the conversion table for key-damper half region is prepared for each of the keys. In the conversion table for key-damper half region, the horizontal axis represents a set of standard values (e.g., MIDI values) of stroke positions of the key, and such a set of standard values (e.g., MIDI values) of stroke positions of the key includes a standard value of a key-damper half region or a key-damper half point. The vertical axis represents a set of local stroke positions of the key in the keyboard musical instrument 30, and such a set of local stroke positions includes a local value of a key-damper half region or a key-damper half point (i.e., half information 76) of the key referenced by the half information reference section 72.

Figure 12:
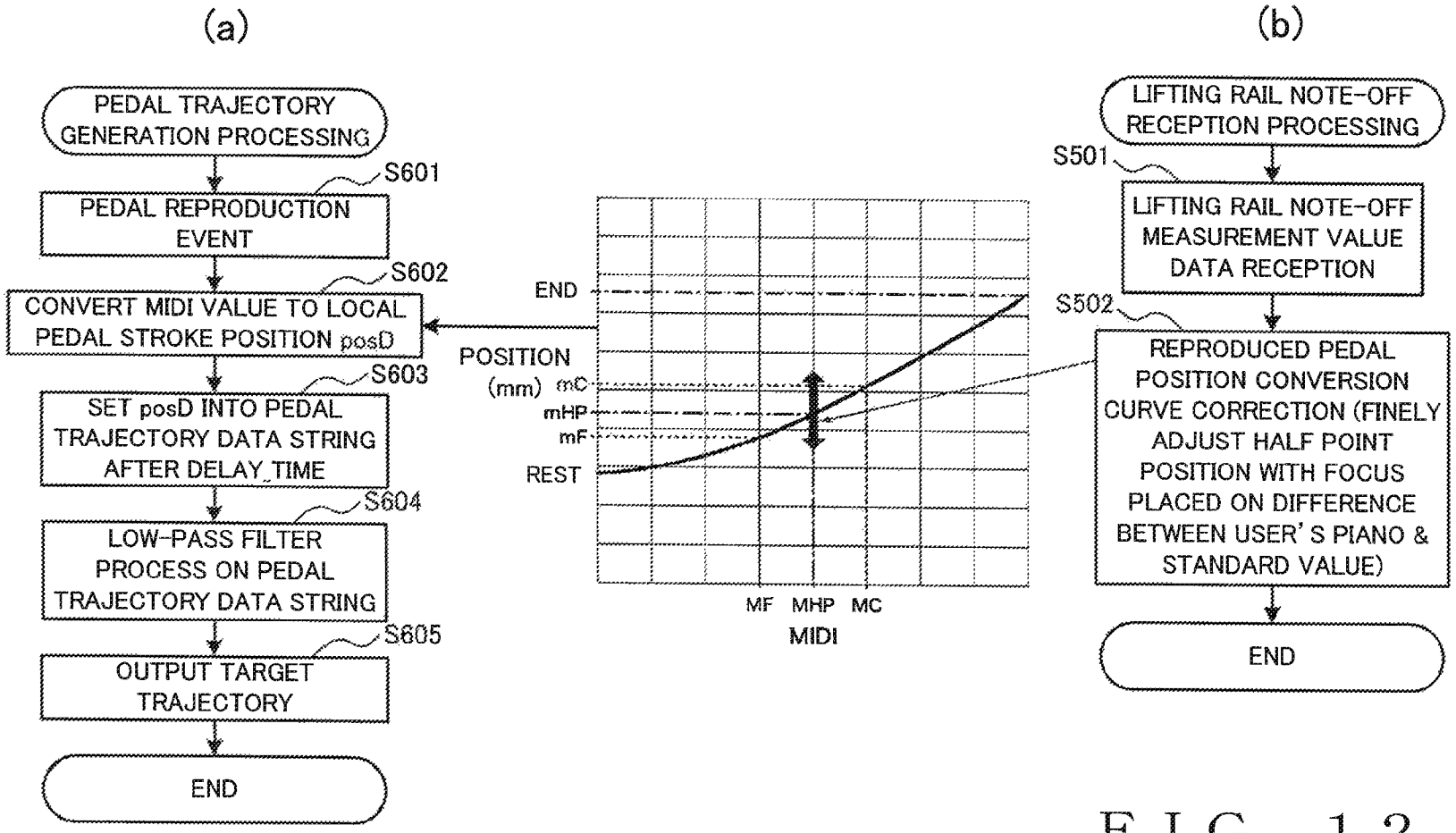

The aforementioned conversion information (conversion table) for the pedal PD may be subjected to a correction process in lifting rail note-off reception processing shown in (b) of FIG. 12 performed by the conversion information generation section 74. For example, in the correction process, lifting rail note-off measurement value data is received at step S501, and then a curve (reproduced pedal position conversion curve) in the conversion information (conversion table) is corrected at step S502. At that time, a half point position is adjusted finely with focus placed on a difference between the user's keyboard musical instrument (piano) 30 and a standard value. For example, there may be employed an approach of achieving matching between local and standard values particularly in a particular pitch range. Note. however, that such a correction process need not necessarily be performed and may be dispensed with.

The following describe, with reference to FIG. 7, automatic performance (reproduction) and performance data recoding processing.

The functions of the half information reference section 72, the half region determination section 73, the conversion information generation section 74, a performance data recording processing section 75 and a reproduction processing section 78 are implemented through cooperation among the CPU 11, the timer 16, the ROM 12, the RAM 13, the sensors and the application programs. The key drive units 20 and the pedal actuator 26 (FIG. 2) correspond to a drive section 79.

First, for the pedal PD, the half information reference section 72 references the half information 71 of the pedal PD (FIG. 3), and the half region determination section 73 determines a half region on the basis of the half information 71. For example, HFR-1 is determined as the half region, and HP-1 is determined as the half point (FIG. 3).

Then, the conversion information generation section 74 creates or generates conversion information (or conversion table) (FIG. 6) for the pedal PD such that the determined half region HFR-1 and the standard half region of the pedal (e.g., MIDI damper pedal half region) correspond to each other. This conversion information (or conversion table) is sent to the performance data recording processing section 75 and the reproduction processing section 78.

For the keys 31, on the other hand, the half information reference section 72 references the half information 76 of each of the keys 31. Then, the conversion information generation section 74 generates conversion information (or conversion table) for each of the keys 31 by associating the key-damper half region identified from the referenced half information 76 with the standard key half region (e.g., key-damper half region or key-damper half point of the MIDI standard). This conversion information (or conversion table) is also sent to the performance data recording processing section 75 and the reproduction processing section 78.

The performance data recording processing section 75 includes a detection section, a conversion section, an event generation section and a recording section. The performance data recording processing section 75 performs processing for recording performance data of the keys, pedal, etc. generated in response to performance operations of a desired music piece, phrase or the like performed by a user using the keyboard musical instrument 30 (particularly the keys 31 and the pedal PD). The performance data recording processing section 75 generates, through later-described processing of FIG. 8, pedal event data (pedal performance data) normalized so as to be capable of being used in another keyboard musical instrument as well, by use of the half region HFR-1 or half point HP-1 determined as above for the pedal PD of the keyboard musical instrument 30 and on the basis of detection results of positions of the pedal PD operated by the user. The thus-generated pedal event data (pedal performance data) can be used as automatic pedal performance information for automatically operating the pedal PD. Further, the performance data recording processing section 75 generates, through later-described processing of FIG. 9, key event data (key performance data) normalized so as to be capable of being used in another keyboard musical instrument as well, by use of the above-mentioned half information 76 indicative of a key-damper half region of the damper of each of the keys 31 relative to key stroke positions and on the basis of detection results of positions of the keys 31 operated by the user. The thus-generated key event data (key performance data) can be used as automatic key performance information for automatically operating the keys 31. Then, the performance data recording processing section 75 generates and records a sequence of automatic performance data (FIG. 11) including the pedal event data and key event data.

Next, with reference to FIGS. 7 and 8 to 10, a description will be given about processing for generating and recording performance data.

Figure 8:
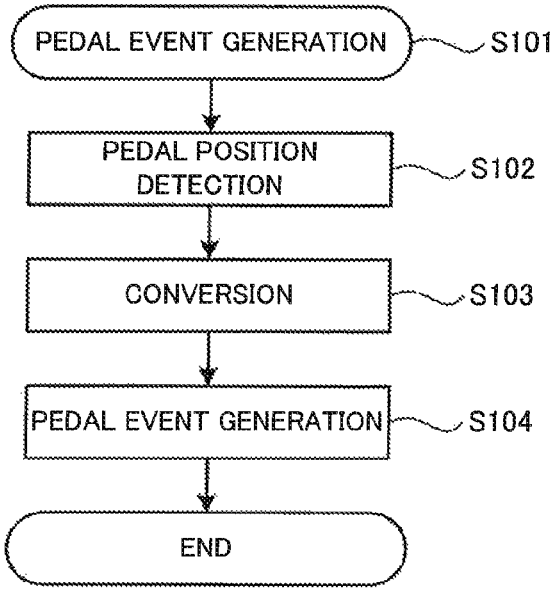
FIG. 8 is a flow chart of pedal event generation processing.
Figure 9:
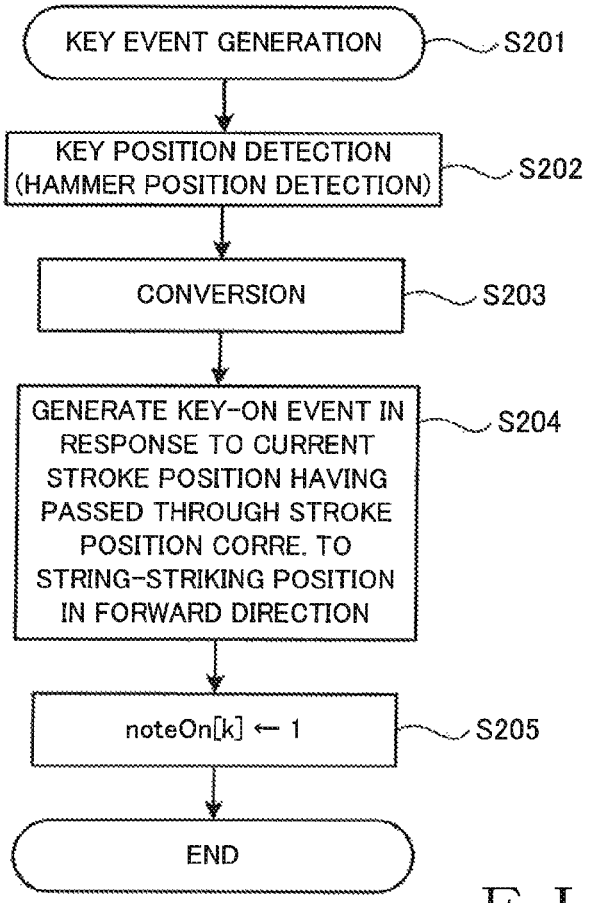
FIG. 9 is a flow chart of key-on event generation processing.
Figure 10:
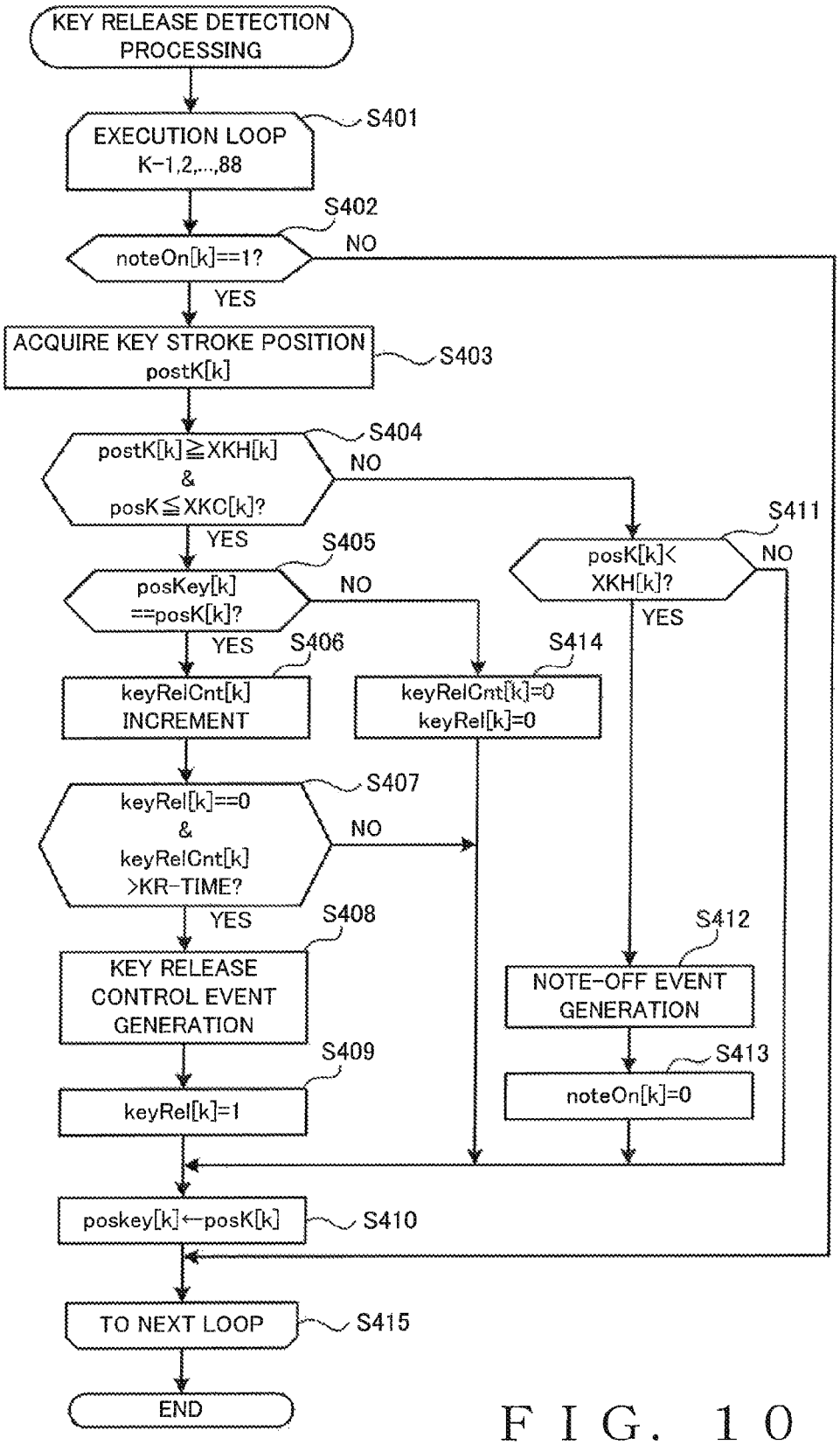
FIG. 10 is a flow chart of key release detection processing.

FIG. 8 is a flow chart of pedal event generation processing, FIG. 9 is a flow chart of key-on event generation processing, and FIG. 10 is a flow chart of key release detection processing. These processing is performed by the performance data recording processing section 75. The pedal event generation processing of FIG. 8 is performed at predetermined sampling time intervals, the key-on event generation processing of FIG. 9 is performed at predetermined sampling time intervals and for each of the keys 31, and the key release detection processing of FIG. 10 is performed at predetermined sampling time intervals.

First, at step S101 of FIG. 8, pedal event generation is started. A current stroke position of the pedal PD is detected from an output of the pedal position sensor 27, at step S102. Then, at step S103, a value of the current stroke position of the pedal PD detected at step S102 is converted in accordance with the conversion information (conversion table) for the pedal PD generated by the conversion information generation section 74. Then, at step S104, a pedal event is generated on the basis of the converted value. Referring to FIG. 6, for example, MIDI values of a pedal event varying from the half start point MF to the half end point MC are generated in response to the pedal PD having moved from the half start point mF to the half end point mC. After that, the instant pedal event generation processing is brought to an end. Namely, with reference to the conversion information (conversion table) for the pedal PD shown in FIG. 6, pedal operation detection data (pedal stroke position detection data) of a half pedal characteristic specific to the pedal PD of the keyboard musical instrument 30 is converted into pedal stroke position data (pedal performance data, i.e. pedal operation instructing data, or more specifically a pedal reproduction event) normalized so as to be capable of being used in another keyboard musical instrument as well.

Namely, the construction related to a pedal event generation section in the performance data recording processing section 75 (i.e., the construction for the CPU 11 to execute the application program as shown in FIG. 8) functions as a performance data generation section configured to generate performance data including data instructing a pedal operation (pedal reproduction event) on the basis of the basis of the single half region (common half region) HFR-1 or HFR-2 or the half pedal point HP-1 or HP-2 and stroke position detected by the pedal position sensor 27.

At step S201 of FIG. 9, key-on event generation is started. A current stroke position of the key 31 is detected from an output of the key sensor unit 37, at step S202. Note that a current stroke position of the hammer HM rather than the current stroke position of the key 31 may be detected from an output of the hammer sensor 59. Then, at step S203, the current stroke position identified from the detection result at step S202 is converted in accordance with the conversion information (conversion table) for the key 31 generated by the conversion information generation section 74. Next, a key-on event is generated at step S204 on the basis of the converted value and in response to a determination that the current stroke position of the key 31 (or hammer HM) has passed through a stroke position corresponding to a predetermined string-striking position in the key-depressing forward direction. At that time, velocity of the key 31 is also detected so that key velocity information is reflected in the key-on event.

Next, a note-on flag noteOn[k] is set to "1" (noteOn[k] →1), where [k] represents a value indicates a key number. After that, the instant key event generation processing is brought to an end. Note that note-on and note-off events will hereinafter sometimes be referred to also as "key-on event" and "key-off event", respectively.

in the key release detection processing of FIG. 10, a note-off event (key-off event) and a release control event are generated. Generally stated, first, a current stroke position of the key 31 is detected from an output of the key sensor unit 37, and a value of the detected current stroke position of the key 31 is converted in accordance with the conversion information (conversion table) for the key 31 generated by the conversion information generation section 74. Then, a release control event is generated on the basis of the converted value and in response to a determination that the key 31 has rested for a predetermined time within a key-damper half region identified from the half information (FIG. 4). Such a resting state of the key 31 is determined by checking whether the key 31 has stayed or rested for the predetermined time (e.g., 100 ms) or longer within a predetermined release control region (e.g., any one of a plurality of sub regions divided from the key-damper half region) set within the key-damper half region corresponding to the key 31. Further, a key-off event is generated on the basis of the converted value and in response to a determination that the key 31 has passed a predetermined position (key-off position) set within the key-damper half region identified from the half information (FIG. 4) during a key release stroke. Specific examples of the aforementioned operations will be described hereinbelow with reference to FIG. 10.

First, at step S401 of FIG. 10, the first key 31 (k=1) is set as a processing object of a current execution loop, and then, at step S402, a determination is made as to Whether noteOn[k] ==1 is established, where "==" is a C-language notation meaning that left-hand and right-hand sides are equal in value. With a NO determination at step S402, the number of the key 31 as the processing object is incremented by one, and the processing goes to a next execution loop at step S415. With a YES determination (noteOn[k]==1) at step S402, on the other hand, a current state is determined to be a note-on state, so that a current key stroke position posK[k] is acquired on the basis of an output of the key sensor unit 37 at step S403.

Then, at step S404, a determination is made as to whether posK[k]>=XKH[k] and posK[k]<=XKC[k] are established, where the sign ">=" means "greater than or equal to" and the sign "<=" means "smaller than or equal to". Here, half point XKH[k] and ceiling point XKC[k] represent a half point mHP and half end point mC, respectively, that correspond to the key 31 of the key number k (see FIG. 6).

If posK[k]>=XKH[k] and posK[k]<=XKC[k] are not established as determined at step S404, a further determination is made at step S411 as to whether posK[k]<XKH[k] is established. If posK[k]<XKH[k] is not established as determined at step S411, it means that the key 31 is currently located at a position deeper in the key-depressing direction than the ceiling point XKC[k] (i.e., key-depressing pressure is still being maintained), and thus, the instant processing goes to step S410 to store a value of the current key stroke position posk[k] into a register posKey[k] provided for storing the key stroke position acquired in the last execution loop. After that, the instant processing goes to step S415.

If, on the other hand, posK[k]>=XKH[k] and posK[k] <=XKC[k] are established as determined at step S404, it means that the key 31 has entered the region lying from the ceiling point XKC[k] to the half point XKH[k] (i.e., release control region) in the key release stroke, and thus, the instant processing goes to step S405 to make a further determination as to whether posKey[k]==posK[k]. Note that, in such a determination, posKey[k] and posK[k] are determined to be equal if a difference therebetween is within a predetermined allowable tolerance. Establishment of posKey[k]==posK[k] means that the key stroke position posKey[k] in the last execution loop and the current stroke position posK[k] match each other, i.e. that the key is temporarily resting during the key release stroke.

If posKey[k]==posK[k] is not established as determined at step S405, "0" is set into a counter keyRelCnt[k] to reset the counter keyRelCnt[k] and "0" is set into a release event flag keyRel[k] at step S414, after that the instant processing goes to step S410. Namely, while the key 31 is not resting, the counter keyRelCnt[k] is always reset so as not to perform its counting operation.

If, on the other hand, posKey[k]==posK[k] is established as determined at step S405, the counter keyRelCnt[k] is incremented at step S406, and a further determination is made at step S407 as to whether keyRel[k]==0 and keyRelCnt[k] >KR−TIME are established. Here, KR−TIME is a value corresponding to the above-mentioned time (100 ms) for determining Whether the key 31 has temporarily rested. Namely, upon determination that the key 31 has temporarily rested, the counter keyRelCnt[k] is incremented to count a time for which the resting state continues. If the executing loop passing through step S406 has been repeated a certain number of times without the counter keyRelCnt[k] being reset, the count value of the counter keyRelCnt[k] gets greater than the predetermined value KR−TIME, so that a YES determination is made at step S407.

If keyRel[k]==0 and keyRelCnt[k]>KR−TIME are not established as determined at step S407, the instant processing goes to step S410. If, on the other hand, keyRel[k]==0 and keyRelCnt[k]>KR−TIME are established as determined at step S407, it means that the key 31 has rested for a predetermined time within a predetermined region lying from the ceiling point XKC[k] to the half point XKH[k] in the key release stroke, i.e. that a key-damper half operation of the key 31 is being performed. Thus, a key release control event is generated at step S408, "1" is set into the release event flag keyRel[k] at step S409, and then the instant processing goes to step S410. Namely, if the key 31 has rested for a predetermined time or longer within a predetermined half region (where posK[k]>=XKH[k] and posK[k]<=XKC[k] are established) during key release, it is determined that a key damper half operation has been performed, and a key release control event is generated.

Then, once the key 31 gets out of the predetermined half region (where posK[k]>=XKH[k] and posK[k]<=XKC[k] are established) as the key release operation progresses, a NO determination is made at step S404, and the instant processing branches to step S411. If posK[k]<XKH[k] is established as determined at step S411, it can be determined that the key 31 has passed through the half point XKH[k] in the key releasing direction, and thus, a note-off event (key-off event) is generated at step S412. Then, the noteOn[k] is set at "0" at step S413, and then the instant processing proceeds to step S410. Whereas it has been described above that a note-off event (key-off event) is generated in response to the key 31 having passed through the half point XKH[k] in the key releasing direction, the present invention is not so limited, and a note-off event (key-off event) may be generated in response to the key 31 having passed through the floor point.

Namely, the construction related to the pedal event generation section in the performance data recording processing section 75 (i.e., the construction for the CPU 11 to execute the application program as shown in FIGS. 9 and 10) functions as a performance data generation section configured to create or generate, on the basis of a key stroke position posK[k] detected by the key sensor unit (detector) 37 and a key-damper half region or key-damper half point HPk specific to the key 31, performance data including data (key release control event or key-off event) instructing an operation of the key 31.

More specifically, the performance data generation section is configured in such a manner that, when the key stroke position posK[k] detected by the key sensor unit (detector) 37 is related to the key-damper half region or key-damper half point HPk specific to the key 31, it generates performance data including normalized data (i.e., key release control event or key-off event) instructing a key operation related to the key-damper half region or key-damper half point. The key release control event is normalized data instructing a half performance operation of the key.

As event data are generated by the processing of FIGS. 8 to 10, they are sequentially stored, and they are recorded as a set of automatic performance data, corresponding to a music piece or a phrase, in response to a recording end instruction given from the user. FIG. 11 shows an example format of an automatic performance data set generated in the aforementioned manner. More specifically, FIG. 11 shows content of an SMF (Standard MIDI File) (which is a file format having MIDI signals recorded) dumped while being shaped on an event-by-event basis.

First, "Header data" is a header section of the SMF, and "#Division=480" in portion "01 E0" in a fifth line of the header data defines that 1/480 of a quarter note is a minimum unit of time information.

"Track data" is a beginning part of a section storing the body of SMF data, and "Length=18861" declares that a data length is 18,861 bytes.

A sequence of events directly influencing a performance is defined in "time event". Times in "time|event" indicate absolute times from the beginning of the automatic performance data set (music piece). Basically, in FIG. 11, one event is expressed per line, except for lengthy events.

"0 FF 51 03 07 53 00 #tempo" defines that a quarter note has a length of 480 ms and that the minimum unit of the time information is 1 msec. "1 F0 7E 7F 09 01 F7 GM ON" defines that the GM (General MIDI) standard is turned on at a time point of 1 ms from the beginning of the music piece.

The following data string divided into a plurality of lines from "480 F0 43 71 7E 40" to "F7" is a string of events defining lifting rail note-off measurement values. Such events are defined at a time point of 480 ms from the beginning of the music piece. For example, "15" in "15 28 33 2D #value of key No. 1" indicates the key 31 of key No. 1, and "28 33 2D" indicates, from left to right, values of the floor point, ceiling point and half point.

Next, "1065 90 3C 4B #note-on", "1066 90 40 44 #note-on" and "1070 90 44 47 #note-on" indicate that the key of key No. "3C" (middle C note) is being sounded at a time point of 1065 ms from the beginning of the music piece, that the key of key No. "40" (middle E note) is being sounded at a time point of 1066 ms from the beginning of the music piece and that the key of key No. "44" (middle G note) is being sounded at a time point of 1070 ins from the beginning of the music piece, respectively. There is no key release at such time points.

Further, "1155 BO 40 00 #damper pedal" to "1762 130 40 71 #damper pedal" indicate that the pedal PD is being depressed, and a fourth byte in these indicates an amount of depression, i.e. a pedal stroke position, and that the depression depth (pedal stroke position) gets gradually deeper like "00", "OF" . . . "60" and "71" from a time point of 1155 ms to a time point of 1762 ms from the beginning of the music piece.

"1950 A0 3C 16" indicates a release control event, of which "3C" represents a key No. and "16" represents a sound volume attenuation inclination. Thus, "1950 A0 3C 16" indicates that the key 31 of "3C" (middle C note) has stayed in the half region for a predetermined time at a time point of 1950 ms from the beginning of the music piece.

Next, "1990 80 3C 2C #note-off", "2005 80 44 36 #note-off" and "2026 80 40 32 #note-off" indicate that three so-far-depressed keys have been released.

The automatic performance data set shown in FIG. 11 serves as information for automatically driving the keys 31 and the pedal PD. Thus, this automatic performance data set can be used as the automatic performance data set 77 in an automatic performance on the keyboard musical instrument 30 but also can serve as general-purpose information usable in an automatic performance on another keyboard musical instrument.

Next, with reference to FIGS. 1, 7, 12 and 13, a description will be given about automatic performance processing based on reproduction of the automatic performance data set 77.

In the reproduction processing section 78, as shown in FIG. 7, a readout section reads out the automatic performance data set 77, and a conversion section converts positions of the pedal PD and the keys 31, defined in the automatic performance data set 77, in accordance with the conversion information (conversion tables) for the pedal PD and the keys 31 generated by the conversion information generation section 74. Then, a trajectory generation generates, on the basis of the converted values, target trajectories of the pedal PD and the individual keys 31 corresponding to progression of time and outputs the generated target trajectories to the drive section 79. Thus, the drive section 79 drives the pedal PD and the keys 31 in accordance with the target trajectories.

The following describe these operations with reference to FIG. 1. First, the motion controller 41 acquires trajectory references generated on the basis of automatic performance data and reflecting therein conversions based on the conversion information. Then, upon lapse of a predetermined sampling time, the motion controller 41 generates a target position (target position data rp) of the pedal PD and target positions (target position data rk) of the keys 31 corresponding to a current time t and outputs the thus-generated target position data rp and rk to the servo controller 42.

Then, the servo controller 42 receives feedback signals yp and yk from the pedal position sensor 27 and the key sensor units 37 and amplifies respective differences between corresponding ones of the feedback signals yp and yk and the target position data rp and rk to obtain electric current instructing values up(t) and uk(t). Then, the servo controller 42 PWM-modifies the electric current instructing values up(t) and uk(t) to output the PWM-modified electric current instructing values to the pedal actuator 26 and the key drive units 20, respectively. Such operations are repeated until an end of a trajectory range is reached. In this manner, the pedal PD and the keys 31 are automatically driven in accordance with the automatic performance data. Referring to FIG. 6, for example, the pedal PD is driven to move from the half start point mF to the half end point mC in response to output of the MIDI values from the half start point MF to the half end point MC.

Figure 13:
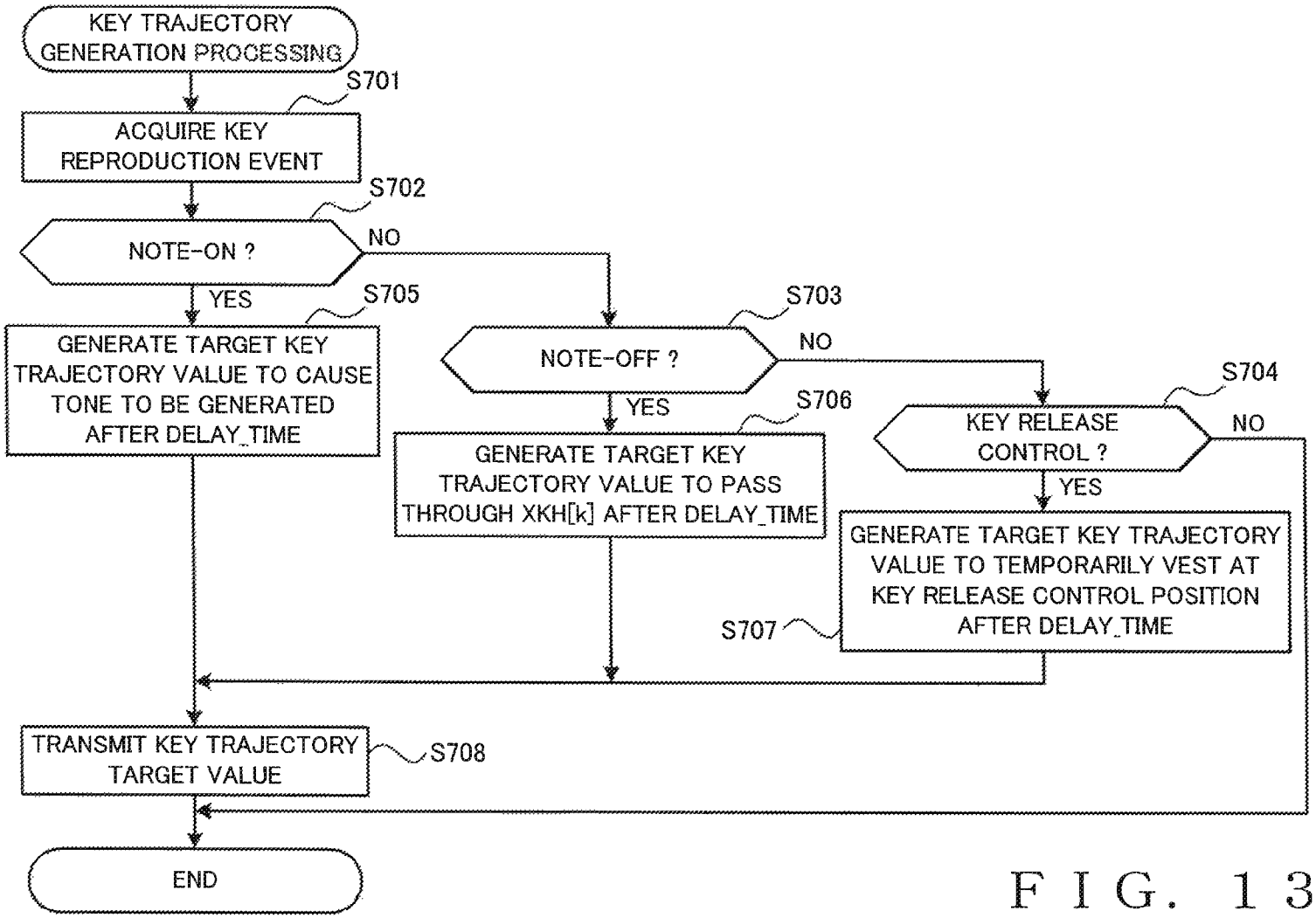
FIG. 13 is a flow chart of key trajectory generation processing.

The following describe, with reference to FIGS. 12 and 13, operational flows of reproduction processing performed in the instant embodiment. (a) of FIG. 12 is a flow chart of pedal trajectory generation processing that is performed by the reproduction processing section 78. (b) of FIG. 12 is a flow chart of the above-mentioned lifting rail note-off reception processing. The pedal trajectory generation processing shown in (a) of FIG. 12 is started in response to reception of a pedal reproduction event, and the lifting rail note-off reception processing shown in (b) of FIG. 12 is started in response to reception of a lifting rail note-off measurement value. A conversion table is shown in a central area of (b) of FIG. 12 for reference purpose.

In the reproduction processing, the automatic performance data set 77 is sequentially read out by the readout section of the reproduction processing section 78. The read-out performance data is passed to a different reproduction processing module corresponding to a type of the performance data. For example, if the read-out performance data is of a pedal reproduction event (i.e., data instructing a pedal operation), it (pedal reproduction event) is passed to a processing module (pedal trajectory generation processing program) shown in (a) of FIG. 12.

In (a) of FIG. 12, the passed performance data, i.e. pedal reproduction event, is received at step S601. This pedal reproduction event (data instructing a pedal operation), which is stroke position data normalized in accordance with a standard half region or half point, indicates, in a MIDI value, a stroke position of the pedal to be reproduced. At next step S602, the pedal stroke position (MIDI value) indicated by the received pedal reproduction event is converted, by use of the conversion information (conversion table), into a local pedal stroke position posD specific to the pedal PD of the keyboard musical instrument 30. Then, at step S603, the thus-converted pedal stroke position posD is set into a pedal trajectory data string delayed with a predetermined delay time "DELAY_TIME". Then, the pedal trajectory data string is subjected to a low-pass filter process to generate a target trajectory at step S604, and the thus-generated target trajectory is output to the drive section 79 at step S605. Note that the above-mentioned predetermined delay time "DELAY_TIME" is a mere design parameter allowing for a delay in an actual reproduction output signal due to a time necessary for the processing and such a delay time "DELAY_TIME" is not necessarily an essential element for carrying out the present invention.

Namely, the aforementioned pedal trajectory generation processing based on a combination of the conversion information generation section 74 and the reproduction processing section 78 or a combination of the application program related to the conversion information generation section 74 and the reproduction processing section 78 and the CPU 11 functions as a generation section that receives performance data including data instructing a pedal operation (pedal reproduction event) and generates a target trajectory of a stroke of the pedal PD on the basis of data instructing an operation of the pedal (pedal reproduction event) and the single half region (HFR-1 or HFR-2) or the half pedal point (HP-1 or HP-2) identified from the acquired information. Further, the above-mentioned drive section 79 (or pedal actuator 26, pedal sensor 27, servo controller 42, etc.) functions as a drive device for driving the pedal PD on the basis of the target trajectory.

The following describe key trajectory generation. As noted above, the read-out performance data in the reproduction processing is passed to the reproduction processing module corresponding to the type of the performance data. If the read-out performance data is of a key reproduction event, it (key reproduction event) is passed to the processing module (key trajectory generation processing program) of FIG. 13.

FIG. 13 is a flow chart of key trajectory generation processing that is performed by the reproduction processing section 78, and this key trajectory generation processing is started in response to reception of a key reproduction event.

First, a key reproduction event is acquired at step S701, and a different process is performed depending on the type of the acquired key reproduction event. Namely, if the acquired event is a note-on event as determined at step S702, the processing goes to step S705 to generate such a target key trajectory value (target trajectory) as to cause a tone to be generated after a delay time DELAY_TIME. If the acquired event is a note-off event as determined at step S703, the processing goes to step S706 to generate such a target key' trajectory value as to pass through a half point XKH[k] in the key releasing direction after the delay time DELAY_TIME. Further, if the acquired event is a key release control event as determined at step S704, the processing goes to step S707 to generate such a target key trajectory value as to temporarily rest at a key release control position after the delay time DELAY_TIME. Then, at step S708, the generated target key trajectory value (target trajectory) is output to the drive section 79.

More specifically, the target key trajectory value generated at step S707 is such a value as to rest the current stroke position of the key corresponding to the key release control event at an appropriate position within the key-damper half region specific to the key 31 (e.g., at a position within the key release control region). Thus, key-damper half control is performed during key release, so that a key-damper half performance is reproduced. Once a key-off event of the key is given after that, a target key trajectory value for key-off control is generated through the operation of step S706, and thus, the key-damper half control is terminated.

The aforementioned key trajectory generation processing based on a combination of the conversion information generation section 74 and the reproduction processing section 78 or a combination of the application program related to the conversion information generation section 74 and the reproduction processing section 78 and the CPU 11 functions as a generation section that that receives performance data including data instructing an operation of the key (key reproduction event) and generates a target trajectory of a stroke of the key on the basis of that data instructing the operation of the key operation (key reproduction event) and the key-damper half region or key-damper half point (HPk) specific to the key. Further, the above-mentioned drive section 79 (or key drive unit 20 etc.) functions as a drive device for driving the key 31 on the basis of the target trajectory.

According to the instant embodiment, during an automatic performance based on the automatic performance data set 77, a target trajectory of the pedal PD is generated on the basis of a half region determined on the basis of the half information (FIG. 3), but also a target trajectory of the key 31 is generated on the basis of the half information (FIG. 4). Thus, correspondency relationship between half regions in the automatic performance data set 77 for use in an automatic performance and half regions in the keyboard musical instrument 30 is appropriately set taking into account half characteristics of the individual dampers 36 in relationship between the pedal PD and the dampers 36 and half characteristics of the individual keys 31 in relationship between the keys 31 and the dampers 36. As a result, the instant embodiment can appropriately reproduce string-releasing/string-contacting movement of the dampers 36 conforming to the intention of the automatic performance data set 77.

Further, according to the instant embodiment, during recording of automatic performance data responsive to a performance, a pedal event is generated on the basis of a half region determined on the basis of the half information (FIG. 3), but also a key event is generated on the basis of a half region determined on the basis of the half information (FIG. 4). Thus, correspondency relationship between half regions in automatic performance data to be generated and half regions in the keyboard musical instrument 30 is appropriately set taking into account half characteristics of the individual dampers 36 in the relationship between the pedal PD and the dampers 36 and half characteristics of the individual keys 31 in the relationship between the keys 31 and the dampers 36. As a result, the instant embodiment can record such automatic performance information that allows key-releasing/key-contacting movement of the dampers 36 during a performance to be appropriately reproduced on another keyboard musical instrument.

Note that the instant embodiment has been described by way of example as employing automatic performance data including half information in both information for driving the pedal PD and information for driving the keys 31. However, in both of the reproduction and the recording, automatic performance data may be handled which include half information in at least one of the information for the pedal PD and the keys 31.

Further, whereas the key 31 has been described as an example of a member of the sounding mechanism Whose motion or movement is to be detected or which is to be driven on the basis of automatic performance data, the present invention is not so limited. For example, such a member of the sounding mechanism may be an intervening component part (member), such as a wippen, that transmits movement of the key 31 to the hammer HM in the action mechanism 33. Namely, by controlling driving of the intervening component part for controlling sound generation, a target component part (member) may be moved along a target trajectory in interlocked relation to the intervening component part. In such a case, these intervening component part and target component part may be different component parts. Namely, the drive device for driving the key 31 on the basis of a target trajectory need not necessarily be constructed to directly drive the key (by means of the key drive unit 20), and the drive device may be constructed to drive a key-related movement transmission mechanism (e.g., key-related action mechanism 33) so as to realize substantively the same function as where it directly drives the key 31.

Similarly, in the present invention, the drive device for driving the pedal PD on the basis of a target trajectory need not necessarily be constructed to directly drive the pedal PD by means of the pedal actuator 26, and the drive device may be constructed to drive a pedal-related movement transmission mechanism (e.g., lifting rail 54) so as to realize substantively the same function as where it directly drives the pedal PD.

Furthermore, whereas the automatic performance data have been described above as input to the keyboard musical instrument by being read out from the storage section, the present invention is not limited to such input form of the automatic performance data, and the automatic performance data may be input to the keyboard musical instrument by being received via a network or MIDI interface.

The present invention is applicable to upright-type keyboard musical instruments as well grand-piano-type keyboard musical instruments. Further, the present invention is also applicable to keyboard musical instruments having a damper function, such as celestas, without its application being limited to piano-type keyboard musical instruments. Namely, the present invention is well suited for application to keyboard musical instruments where sound generation and sound deadening is controlled in response to operations of keys and where a way of deadening of a sound is controlled via a damper. Further, keyboard musical instruments to which the reproduction function of the present invention is applicable are not limited to those having mechanical sound generators like keys and may be ones having electronic sound generators.

Furthermore, whereas the present invention has been described above in relation to preferred embodiments, it should be appreciated that the present invention is not limited to such particular embodiments and embraces various forms of implementations without departing from the gist of the invention.

This application is based on, and claims priority to, JP PA 2013-082851 filed on 11 Apr. 2013. The disclosure of the priority application, in its entirety, including the drawings, claims, and the specification thereof, are incorporated herein by reference.

What is claimed is:

1. A keyboard musical instrument comprising:

a plurality of keys each configured to control generation and deadening of a corresponding sound in response to an operation of the key;

a plurality of dampers each provided in corresponding relation to one of the keys and configured to be driven, in response to an operation of the corresponding key, to control deadening of a sound corresponding to the key;

a pedal configured to collectively drive the plurality of dampers;

a sensor configured to detect a stroke position of the pedal; and a processor configured to execute:

an acquisition task that acquires information identifying one half region or half point in a stroke of the pedal, the one half region or half point being determined based on a plurality of half pedal regions or half pedal points, in the stroke of the pedal, specific to individual ones of the dampers;

a performance data generation task that generates performance data including data instructing a pedal operation, based on the one half region or half point identified by the information and the stroke position detected by the sensor; and a recording task that records the performance data including data instructing a pedal operation generated by the performance data generation task.

2. The keyboard musical instrument as claimed in claim 1, further comprising:

a memory storing the plurality of half pedal regions or half pedal points specific to the individual dampers acquired in advance, wherein the acquisition task:

reads the plurality of half pedal regions or half pedal points specific to the individual dampers from the memory; and determine the one half region or half point based on the referenced plurality of half pedal regions or half pedal points specific to the individual dampers.

3. The keyboard musical instrument as claimed in claim 2, wherein the one half region is determined based on a depression-end-side end position closest to a depression end of the pedal among depression-end-side end positions in the plurality of half pedal regions specific to the individual dampers and a rest-position-side end position closest to a rest position of the pedal among rest-position-side end positions in the plurality of half pedal regions.

4. The keyboard musical instrument as claimed in claim 1, further comprising a memory storing the information identifying the one half region or half point determined in advance based on the plurality of half pedal regions or half pedal points specific to the individual dampers.

5. The keyboard musical instrument as claimed in claim 1, wherein:

the performance data generation task converts the stroke position detected by the sensor into normalized stroke position data in accordance with a conversion table for associating the one half region or half point, identified by the information, with a predetermined standard half region or half point, and the performance data generation task generates the performance data including the normalized stroke position data as the data instructing a pedal operation.

6. A method of recording a pedal performance on a keyboard musical instrument, the keyboard musical instrument including:

a plurality of keys each configured to control generation and deadening of a corresponding sound in response to an operation of the key;

a plurality of dampers each provided in corresponding relation to one of the keys and configured to be driven, in response to an operation of the corresponding key, to control deadening of a sound corresponding to the key;

a pedal configured to collectively drive the plurality of dampers;

a sensor configured to detect a stroke position of the pedal; and a processor, wherein the processor executed the method comprising:

an acquisition step of acquiring information identifying one half region or half point in a stroke of the pedal, the one half region or half point being determined based on a plurality of half pedal regions or half pedal points, in the stroke of the pedal, specific to individual ones of the dampers;

a performance data generation step of generation performance data including data instructing a pedal operation, based on the one half region or half point identified by the information and the stroke position detected by the sensor; and a recording step of recording the performance data including data instructing a pedal operation generated in the performance data generation step.

7. A non-transitory computer-readable storage medium storing a program for implementing a method of recording a pedal performance on a keyboard musical instrument, the keyboard musical instrument including:

a plurality of keys each configured to control generation and deadening of a corresponding sound in response to an operation of the key;

a plurality of dampers each provided in corresponding relation to one of the keys and configured to be driven, in response to an operation of the corresponding key, to control deadening of a sound corresponding to the key;

a pedal configured to collectively drive the plurality of dampers;

a sensor configured to detect a stroke position of the pedal; and a processor, wherein the program is executed by the processor to execute the method comprising:

an acquisition step of acquiring information identifying one half region or half point in a stroke of the pedal, the one half region or half point being determined based on a plurality of half pedal regions or half pedal points, in the stroke of the pedal, specific to individual ones of the dampers;

a performance data generation step of generating performance data including data instructing a pedal operation, based on the one half region or half point identified by the information and the stroke position detected by the sensor; and a recording step of recording the performance data including data instructing a pedal operation generated in the generation step.

8. A keyboard musical instrument comprising:

a plurality of keys each configured to control generation and deadening of a corresponding sound in response to an operation of the key;

a plurality of dampers each provided in corresponding relation to one of the keys and configured to be driven, in response to an operation of the corresponding key, to control deadening of a sound corresponding to the key;

a plurality of detectors each provided in corresponding relation to one of the plurality of keys, with each detector configured to detect a stroke position of the corresponding one key;

a processor configured to execute:

an acquisition task that acquires, for each of the plurality of keys, information identifying a key-damper half region or key-damper half point, in a stroke of the respective key;

a performance data generation task the generates performance data including data instructing key operations, based on the stroke positions of the keys detected by the detectors and the key-damper half regions or key-damper half points specific to the individual ones of the keys; and a recording task that records the performance data including data instructing key operations data generated by the performance data generation task.

9. The keyboard musical instrument as claimed in claim 8, wherein, when the stroke position of a key, among the plurality of keys, detected by the respective one detector is related to the key-damper half region or key-damper half point specific to that key, the performance data generation task generates the performance data including normalized data instructing a key operation related to a key-damper half region or key-damper half point specific to that key.

10. The keyboard musical instrument as claimed in claim 9, wherein the performance data generation task generates, as the normalized data, data instructing a half performance operation, in response to the stroke position, during key release, of a key, among the plurality of keys, having stayed for a predetermined time or longer within the key-damper half region or at the key-damper half specific to that key.

11. The keyboard musical instrument as claimed in claim 9, wherein the performance data generation task generates, as the normalized data, key-off event data instructing key release in response to the stroke position, during key release, of a key, among the plurality of keys, having passed through a predetermined key-off position set within the key-damper half region specific to that key.

12. The keyboard musical instrument as claimed in claim 11, wherein the performance data generation task generates, as the normalized data, data instructing a half performance operation, in response to the stroke position, during key release, of a key, among the plurality of keys, having stayed for a predetermined time or longer within a predetermined release control region set within the key-damper half region specific to that key.

13. A method of recording a key-damper half performance on a keyboard musical instrument, the keyboard musical instrument including:

a plurality of keys each configured to control generation and deadening of a corresponding sound in response to an operation of the key;

a plurality of dampers each provided in corresponding relation to one of the keys and configured to be driven, in response to an operation of the corresponding key, to control deadening of a sound corresponding to the key;

a plurality of detectors each provided in corresponding relation to one of the plurality of keys, with each detector configured to detect a stroke position of the corresponding one key; and a processor, wherein the processor executes the method comprising:

an acquisition step of acquiring, for each of the plurality of keys, information identifying a key-damper half region or key-damper half point, in a stroke of the respective key;

a performance data generation step of generating performance data including data instructing key operations, based on the stroke positions of the keys detected by the detectors and the key-damper half regions or key-damper half points specific to the individual ones of the keys; and a recording step of recording the performance data including data instructing key operations data generated in the generation step.

14. A non-transitory computer-readable storage medium storing a program for implementing a method for recording a key-damper half performance on a keyboard musical instrument, the keyboard musical instrument including:

a plurality of keys each configured to control generation and deadening of a corresponding sound in response to an operation of the key;

a plurality of dampers each provided in corresponding relation to one of the keys and configured to be driven, in response to an operation of the corresponding key, to control deadening of a sound corresponding to the key; and a plurality a detectors each provided in corresponding relation to one of the plurality of keys, with each detector configured to detect a stroke position of the corresponding one key; and a processor, wherein the program is executable by the processor to execute the method comprising:

an acquisition a step of acquiring, for each of the plurality of keys, information identifying a key-damper half region or key-damper half point, in a stroke of the respective key;

a performance data generation step of generating performance data including data instructing key operations, based on the stroke positions of the keys detected by the detectors and the key-damper half regions or key-damper half points specific to the individual ones of the keys; and a recording step of recording the performance data including data instructing key operations data generated in the generation step.

* * * * *